US011155889B2

(12) United States Patent
Larsen et al.

(10) Patent No.: US 11,155,889 B2
(45) Date of Patent: Oct. 26, 2021

(54) PELT BOARD BAG AND AN ASSEMBLY OF A PELT BOARD BAG AND A PELT BOARD

(71) Applicant: MINKPAPIR A/S, Holstebro (DK)

(72) Inventors: Johnny Larsen, Aalborg (DK); Poul Erik Primdahl, Holstebro (DK)

(73) Assignee: MINKPAPIR A/S, Holstebro (DK)

( * ) Notice: Subject to any disclaimer, the term of this patent is extended or adjusted under 35 U.S.C. 154(b) by 67 days.

(21) Appl. No.: 16/486,094

(22) PCT Filed: Feb. 27, 2018

(86) PCT No.: PCT/EP2018/054814
§ 371 (c)(1),
(2) Date: Aug. 14, 2019

(87) PCT Pub. No.: WO2018/158252
PCT Pub. Date: Sep. 7, 2018

(65) Prior Publication Data

US 2020/0056253 A1 Feb. 20, 2020

(30) Foreign Application Priority Data

Feb. 28, 2017 (EP) ..... 17158331

(51) Int. Cl.
*C14B 15/06* (2006.01)
*C14B 1/26* (2006.01)
*C14B 1/58* (2006.01)

(52) U.S. Cl.
CPC ..... *C14B 15/06* (2013.01); *C14B 1/26* (2013.01); *C14B 1/58* (2013.01)

(58) Field of Classification Search
CPC ..... C14B 15/06; C14B 1/26; C14B 1/58
See application file for complete search history.

(56) References Cited

U.S. PATENT DOCUMENTS 3,476,109 A * 11/1969 Hurney ..... A61F 13/105 602/1
3,479,802 A * 11/1969 Fesco ..... A47L 9/14 55/367

(Continued)

FOREIGN PATENT DOCUMENTS

CA 2570227 12/2005
DK 174852 12/2003

(Continued)

OTHER PUBLICATIONS

Non-Final Office Action on co-pending (U.S. Appl. No. 15/756,257) dated Sep. 3, 2019.

(Continued)

*Primary Examiner* — Shaun R Hurley
(74) *Attorney, Agent, or Firm* — Klein, O'Neill & Singh, LLP

(57) ABSTRACT

A pelt board bag for use in combination with a pelt board for the tanning and drying of a pelt applied externally to the pelt board bag comprises a pair of oppositely positioned and substantially coextensively extending, elongated sheets. The pair of sheets are joined together along opposite longitudinal edges and define in a first state a flat two-layer structure and in a second state a basically tubular state. The pair of sheets define opposite first and second ends. The first end constitutes a narrow open end constituting a top end when used in combination with the pelt board, and the second end constitutes a broader bottom end when used in combination with the pelt board. The pair of sheets define in the second state an inner perimeter varying from the first narrow end to the broader second end. The pair of sheets have a region at a specific inner perimeter, which is provided with slits, oblong apertures, embossings, score lines or folds allowing the region to be expanded at least in one direction longitudinally or transversely when in the second state. Each of the (Continued)

Figure 1:
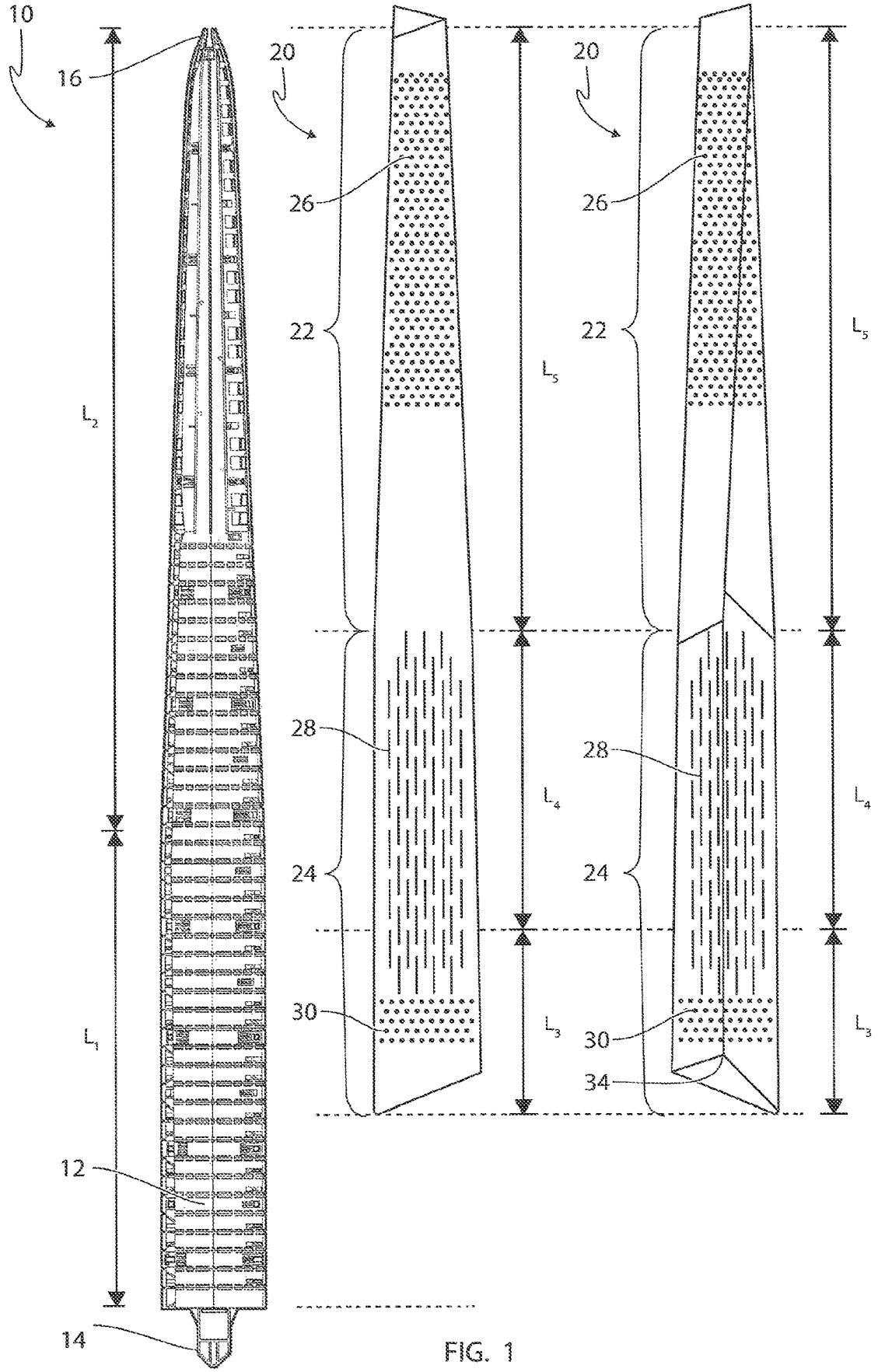

longitudinal edges defines a respective fold line at which the material is folded and the fold lines are provided with slits, oblong apertures, embossings, score lines or folds and extend substantially between the first end and the second end.

14 Claims, 15 Drawing Sheets

(56) References Cited

U.S. PATENT DOCUMENTS

| | | | | |
|---|---|---|---|---|
| 4,294,240 | A * | 10/1981 | Thill | A61F 13/041 602/21 |
| 6,701,756 | B2 | 3/2004 | Hedegaard | |
| 7,578,153 | B2 * | 8/2009 | Hedegaard | C14B 1/26 69/19.1 |
| 7,690,228 | B2 | 4/2010 | Hedegaard | |
| D705,047 | S * | 5/2014 | Pedersen | D8/499 |
| 8,863,560 | B2 * | 10/2014 | Pedersen | C14B 1/26 69/19.2 |
| 9,499,871 | B2 | 11/2016 | Pedersen | |
| 2003/0019255 | A1 * | 1/2003 | Hedegaard | C14B 15/06 69/22 |
| 2013/0152642 | A1 * | 6/2013 | Pedersen | C14B 1/26 69/19.1 |
| 2017/0051366 | A1 | 2/2017 | Pedersen | |
| 2017/0313017 | A1 * | 11/2017 | Cheich | B31D 5/0069 |
| 2018/0209003 | A1 | 7/2018 | Larsen | |
| 2018/0245170 | A1 * | 8/2018 | Larsen | C14B 15/06 |
| 2019/0017127 | A1 | 1/2019 | Larsen | |

FOREIGN PATENT DOCUMENTS

| | | | | |
|---|---|---|---|---|
| DK | 174865 | | 1/2004 | |
| DK | 200301592 | | 4/2005 | |
| DK | 9600208 | | 9/2005 | |
| DK | 176683 | | 2/2009 | |
| DK | 177582 | | 10/2013 | |
| DK | 201570184 | | 3/2015 | |
| EM | EU001303085 | | 10/2011 | |
| EP | 1285094 | | 2/2003 | |
| EP | 1759022 | | 8/2012 | |
| EP | 3366787 | | 8/2018 | |
| GB | 2211203 | | 6/1989 | |
| WO | WO1986/000091 | | 1/1986 | |
| WO | WO2005/026394 | | 3/2005 | |
| WO | WO2005/028682 | | 3/2005 | |
| WO | WO-2009076963 | A1 * | 6/2009 | C14B 15/06 |
| WO | WO2014/187723 | | 11/2014 | |
| WO | WO2015/144774 | | 10/2015 | |
| WO | WO2017/036948 | | 3/2017 | |

OTHER PUBLICATIONS

International Search Report on corresponding PCT application (PCT/EP2018/054814) from International Searching Authority (EPO) dated Mar. 21, 2018.

Written Opinion on corresponding PCT application (PCT/EP2018/054814) from International Searching Authority (EPO) dated Mar. 21, 2018.

International Search Report on corresponding PCT application (PCT/EP2016/070172) from International Searching Authority (EPO) dated Nov. 30, 2016.

Written Opinion on corresponding PCT application (PCT/ EP2016/070172) from International Searching Authority (EPO) dated Nov. 30, 2016.

* cited by examiner

PELT BOARD BAG AND AN ASSEMBLY OF A PELT BOARD BAG AND A PELT BOARD

CROSS-REFERENCE TO RELATED APPLICATIONS

This application is the national phase entry, under 35 U.S.C. Section 371(c), of International Application No. PCT/EP2018/054814, filed Feb. 27, 2018, claiming priority from European Patent Application No. 17158331.3, filed Feb. 28, 2017. The disclosures of the International Application and the European Application from which this application claims priority are incorporated herein by reference in their entirety.

FEDERALLY SPONSORED RESEARCH OR DEVELOPMENT

Not Applicable

The present invention relates to a pelt board bag and an assembly of a pelt board bag and a pelt board.

BACKGROUND OF THE INVENTION

In the fur industry, animal pelts are often stretched in a non-destructive way in order to maximize the size of the pelt. The pelts define a substantially tubular shape and have an outwardly oriented fur side and an inwardly oriented leather side. The stretching takes place after skinning the animal and scraping off the layer of fat on the leather side of the pelt and before the drying of the pelt. In the present context, the word pelt is understood to encompass pelts of minks, foxes and similar small mammals. The pelts are often stretched on a pelt board, which is nowadays made of plastic as a pelt board bag is interlayered between the pelt board and the pelt. Normally, the leather side of the pelt is facing the pelt board bag, which is made from a fat absorbing and possibly also moisture absorbing material such as a paper bag or sleeve, which is in contact with the leather side of the pelt. The fur side of the pelt is thereby facing outwardly during the stretching and drying of the pelt.

The stretching procedure and the use of pelt boards are known per se and both are disclosed in e.g. WO 2005/028682 A1. Therein is disclosed the use of a gripping element which is brought in engagement with the whole periphery of the pelt and the drawing of a fixing bag over the outside of the pelt in order to maintain the pelt in a stretched configuration during the drying of the pelt. Thereby, the previous use of staples and the thus produced elongated holes in the pelts may be avoided.

In relation to the above terminology, the word bag which in its normal understanding may describe a sleeve with a closed off bottom should in the present circumstances and further along in the present patent application be understood to also encompass sleeves which are not closed off and which have a tubular or cylindrical shape without a closed off bottom.

Within the relevant technical field, numerous examples are presented in relation to improved pelt board bags, which are described among others in the applicant company's patents: DK 174852, DK 174865, EP 1 285 094, EP 1 759 022, DK 176683, U.S. Pat. No. 8,863,560, and applicant's EU design registration EU 0013030085.

Further examples are presented in Danish patent 177582 and pending Danish patent application 2015 70184.

The use of a pelt board bag such as a fat and moisture absorbing pelt board bag in combination with a pelt board when tanning and drying the pelt, calls for several conflicting concerns as on the one hand, the pelt board bag should be easily applied to the pelt board and on the other hand be sticking to the pelt after finalizing the drying when the pelt is removed from the pelt board bag rather than being removed together with the pelt from the pelt board. The technical conflict between on the one hand an easy mounting of the pelt board bag on the pelt board prior to the mounting of the pelt externally relative to the pelt board bag and on the other hand the retaining of the pelt board bag after the drying of the pelt without removing the pelt board bag sticking to the pelt is further exaggerated in accordance with today's standard of pelt boards, which are collapsible pelt boards, i.e. at the time of applying the pelt board bag, the pelt board is non-collapsed or expanded, whereas at the time the pelt is removed and the pelt board bag should stay or be retained on the pelt board, the pelt board is collapsed, which causes a reduced contact between the inner side of the pelt board bag and the reduced—as compared to the non-collapsed or expanded state of the pelt board—outer surface of the pelt board.

In accordance with specific examples described in the above-listed prior art, the pelt board bags have been suggested produced as bags, which are configured in conformity with the outer surface of the non-collapsed or expanded pelt board, i.e. having a configuration in conformity with the configuration or shape of the non-collapsed or expanded pelt board, which evidently highly increases the possibility that the pelt board bag will be loosened from its contact with the pelt board at the time the pelt board is collapsed as discussed above.

An object of the present invention is to provide a pelt board bag, which is kept in contact with and remains in contact with the pelt board at the time the pelt board is shifted to its collapsed state, and the pelt is removed from its tight contact with the outer surface of the pelt board bag.

It is an object of the present invention to provide a novel pelt board bag which on the one hand allows for an easy mounting of the pelt board bag on the pelt board, the pelt board being in its non-collapsed or collapsed state and which on the other hand remains safely on the pelt board at the time the pelt board bag is removed.

In the present case reference is also made to the yet unpublished international application number PCT/EP2016/070172, which describes a pelt board bag and associated assembly of a pelt board bag and the board similar to the ones described herein including a pelt board bag having a region including the slits, oblong apertures, embossings, score lines or folds, which allow the pelt board bag to be expanded when mounted on the pelt board, or allows the pelt board bag to expand when applied to the collapsed pelt board prior to the pelt board being shifted from its collapsed state to its non-collapsed or expanded state.

Notwithstanding the advantages of such region, which advantages are explained in the above mentioned international application and further below, the regions have the disadvantage of making any folding of the pelt board bag difficult, as well as any transition from a flat two-layer structure to a basically tubular state more difficult as the slits, oblong apertures, embossings, score lines, folds etc will naturally interfere, being natural folding locations. It is thus a further object according to the present invention to provide technologies for allowing an easier folding of the pelt board bag.

The above objects together with numerous other objects, features and advantages, which will be evident from the below description of the present invention are, according to a first aspect of the present invention, obtained by a pelt board bag of a fat absorbing and optionally and preferably also moisture and water absorbing material for use in combination with and applied externally to a pelt board for the tanning and drying of a pelt applied externally to the pelt board bag, said bag comprising:

i) a pair of oppositely positioned and substantially coextensively extending, elongated sheets of said material, ii) said pair of sheets being joined together along opposite longitudinal edges and defining in a first state a flat two-layer structure and in a second state a basically tubular state, iii) said pair of sheets defining opposite first and second ends, said first end constituting a narrow open end constituting a top end when used in combination with said pelt board and said second end constituting a broader bottom end when used in combination with said pelt board, said pair of sheets defining in said second state an inner perimeter varying from said first narrow end to said broader second end, iv) said pair of sheets or at least one of said pair of sheets having a region at a specific inner perimeter, said region being provided with slits, oblong apertures, embossings, score lines or folds or combinations thereof allowing said region to be expanded at least in one direction longitudinally or transversely when in said second state, and v) each of said longitudinal edges defining a respective fold line, at which said material is folded, said fold lines being provided with slits, oblong apertures, embossings, score lines, folds or combinations thereof and extending substantially between said first end and said second end.

According to the teachings of the present invention, the pelt board bag is basically of a structure which is undersized as compared to the pelt board, in particular undersized relative to the pelt board being in the non-collapsed or expanded state, and the pelt board bag being provided with the provisions of expandable or deformable parts constituted by the region including the slits, oblong apertures, embossings, score lines or folds, which allow the pelt board bag to be expanded when mounted on the pelt board or allows the pelt board bag to expand when applied to the collapsed pelt board prior to the pelt board being shifted from its collapsed state to its non-collapsed or expanded state.

The region constituting an expandable or deformable part or including the expandable or deformable part or parts may as stated above include slits, oblong apertures, embossings, score lines or folds. The slits, oblong apertures, embossings or score lines may, as will be discussed below, have different orientations as compared to the longitudinal direction or extent of the pelt board bag, whereas the folds which may be constituted by overlayered parts of the material from which the pelt board bag is produced may serve to allow the entire pelt board bag structure to be unfolded by the expansion for adjusting the size and configuration of the pelt board bag to the configuration and size of the pelt board at the time the pelt board bag is applied to the pelt board or after the pelt board bag has been applied and the pelt board is shifted from its collapsed state to its non-collapsed or expanded state.

The region characteristic of the present invention may constitute a fairly small area or region along the longitudinal extent of the pelt board bag, however, according to specific embodiments to be described below with reference to the drawings, the region constitutes almost the entire outer surface of the pelt board bag.

Importantly, in the present context, the terms sheet and longitudinal edge refer to the opposing layers of flat two-layer structure of the pelt board bag, which not necessarily defines the boundaries of the fat absorbing material itself. In fact, at least one, and preferably both of the opposite longitudinal edges along which the sheets being joined together, are not constituted by a boundary in the material, but by a folding line. The folding line allows the material to be folded, thereby defining the pair of sheets forming the opposing layers of the pelt board bag. This allows the pelt board bag to remain strong at the longitudinal edges of the pelt board bag, which would normally absorb a high stress due to the convex shape of the board. The folding line is understood to be a location intended for folding.

The folding lines are provided with a folding instruction in the form of slits, oblong apertures, embossings, score lines, folds or combinations thereof along the full length of the pelt board bag. This allows the pelt board bag to be easily established by folding the material and allows the finished pelt board bag to be easily shifted between the first and second position. The provision of the slits, oblong apertures, embossings, score lines, folds or combinations thereof along the full length of the pelt board bag will significantly reduce the likelihood that the longitudinal fold establishing the edge and the location determining the transition from a flat two-layer structure to a basically tubular state, will occur at another position than the intended fold lines.

Provided the region has a fairly large extent, the region will, according to the advantageous and preferred embodiments of the pelt board bag according to the present invention, be bound by two inner perimeters along the longitudinal extent of the pelt board bag. It is of course to be understood that the pelt board bag according to the present invention may include more than a single region allowing for the expansion when applying the pelt board bag to the pelt board as several regions may be located along the longitudinal extent of the pelt board bag for providing the intentional expansion of the region or the regions at positions dedicated for the expansion purpose and defined primarily from the outer configuration and dimensions of the pelt board to which the pelt board bag is to be applied and in combination with which the pelt board bag is to be used.

In accordance with further characteristics of the pelt board bag according to the present invention, the pelt board bag may have—when in the second state—an overall conical configuration or a configuration composed of one or more cones and/or circular cylindrical section for allowing the pelt board bag to be configured and shaped in accordance with the pelt board with which the pelt board bag is to be used, and the cones and/or circular cylindrical sections provided by the pelt board bag in the second state of the pelt board bag may constitute sections including the region or regions characteristic of the present invention or interconnecting two or more regions or constitute non-expandable part or parts of the pelt board bag.

In a specific embodiments allowing the pelt board bag to be used in combination with a pelt board such as the pelt board implemented in accordance with the standard defined by Kopenhagen Fur A/S, the region is provided at a conical part of the pelt board bag such as a part corresponding to a tapered part of said pelt board or at a transition from a higher taper to a lower taper corresponding to the transition at the pelt board between a tapering part and a non-tapering part.

The expansion of the region characteristic of the pelt board bag according to the present invention may be provided for allowing expansion longitudinally or transversely and in order to provide the longitudinal and/or transversal expansion, the slits, oblong apertures, embossings or score lines of the region may extend transversely or longitudinally, respectively, relative to the pelt board bag. Alternatively, according to a further embodiment of the pelt board bag according to the present invention, the slits, oblong apertures, embossings or score lines are provided as sloping slits oblong apertures, embossings or score lines for allowing expansion in the longitudinal direction and/or simultaneously in the transversal direction.

According to a specific feature of the pelt board bag of the present invention, it has been realized that slits, oblong apertures, embossings or score lines simply cut into the material such as the paper material from which the pelt board bag is produced and may give origin to tearing the sheet material when expanding the region of the pelt board bag, and in order to prevent such tearing of the sheet material, e.g. the paper material from which the pelt board bag is produced, the slits, oblong apertures, embossings or score lines may be provided with rounded apertured ends simply for preventing the tearing propagation.

The slits, embossings or score lines are as such preferably made as linear slits, embossings or score lines, respectively, though curved or otherwise configured slits, embossings or score lines may be provided, e.g. for combining the feature of the longitudinal and transversal extending slits, embossings or score lines for providing expansion in the transversal and longitudinal direction of the pelt board bag.

The pelt board bag may as such be produced from standard materials such as paper or cardboard for providing a disposable bag as the material of the pelt board bag will be soaked by fat after the drying of the pelt has taken place. According to an alternative embodiment, the pelt board bag may be made from synthetic or natural fibers or a combination of fibers and paper or cardboard material and provided synthetic or natural fibers be used, the pelt board bag may be a non-disposable bag, which after use may be rinsed or cleaned for allowing for more than a single use.

In an advantageous embodiment, the pair of sheets forming the pelt board bag may constitute a folded unitary piece of said material. The using of a unitary piece of material implies that a single sheet is folded once or twice in order to form the two layer structure of the pelt board bag. In this way, the pelt board bag may be formed by assembling or bonding the longitudinal boundaries of the material requiring only one single longitudinal joint, which may be formed at one of the longitudinal edges of the pelt board bag, or preferably anywhere between the longitudinal edges on one of the sheets, thus dividing said sheet into two adjacent parts.

The unitary piece of material may thus be folded twice in order to achieve the two layer structure of the pair of sheets forming the pelt board bag, of which one of the sheets define two approximately equally sized parts being positioned side-by-side or slightly overlapping relative to the longitudinal direction and joined together by any well-known assembling- or bonding techniques. Thus, one of the pair of sheets will constitute two parts joined together, whereas the opposing sheet will form a uniform face. In this way, the area of the sheets at longitudinal edges separating the pair of sheets will be part of the uniform piece of material making this part of the pelt board relatively stronger, as this part of the pelt board bag will be subjected to a higher stress than the area between the longitudinal edges due to the convex shape of the typically used pelt boards. Alternatively, the pelt board bag may be made up of two pieces of material, e.g. being bonded by joints at each of the sheets.

The assembling of the sheets of the pelt board bag into the pelt board for allowing the pelt board to be shifted from its first state constituting a flat two-layer structure into a second state of a basically tubular state, well-known assembling techniques such a gluing, welding or hinge connections may be used for joining the sheets of the pelt board bag along the opposite longitudinal edges. It is to be understood, however, that the pelt board bag as such may be assembled from more than two sheets as one of the sheets or both sheets may themselves be assembled from two or more parts such as two parts being positioned side-by-side relative to the longitudinal direction of the pelt board bag or alternatively or in addition constituted by parts which are positioned overlayered or positioned end-to-end along the longitudinal direction of the pelt board bag.

The above objects together with numerous other objects, features and advantages, which will be evident from the below description of the present invention are, according to a second aspect of the present invention, obtained by an assembly of a pelt board bag of a fat absorbent and optionally and preferably also moisture and water absorbent material and a pelt board for use in combination with said pelt board bag for applying said pelt board bag externally to said pelt board for tanning and drying of a pelt applied externally to said pelt board bag, said bag comprising:

i) a pair of oppositely positioned and substantially coextensively extending, elongated sheets of said material, ii) said pair of sheets being joined together along opposite longitudinal edges and defining in a first state a flat two-layer structure and in a second state a basically tubular state, iii) said pair of sheets defining opposite first and second ends, said first end constituting a narrow open end constituting a top end when used in combination with said pelt board and said second end constituting a broader bottom end when used in combination with said pelt board, said pair of sheets defining in said second state an inner perimeter varying from said first narrow end to said broader second end, iv) said pair of sheets or at least one of said pair of sheets having a region at a specific inner perimeter, said region being provided with slits, oblong apertures, embossings, score lines or folds or combinations thereof allowing said region to be expanded at least in one direction longitudinally or transversely when in said second state, v) each of said longitudinal edges defining a respective fold line at which said material is folded, said fold lines being provided with slits, oblong apertures, embossings, score lines, folds or combinations thereof and extend substantially between said first end and said second end, and vi) said pelt board being shiftable between a collapsed state and a non-collapsed state, and said pelt board bag being applicable externally to said pelt board when in said collapsed state without expanding said region and said region being expanded when said pelt board bag is in said non-collapsed state or is caused to be expanded when shifting said pelt board from said collapsed state to said non-collapsed state.

The assembly according to the second aspect of the present invention may as such be implemented including any of the above-described advantageous features of the pelt board bag according to the first aspect of the present invention.

The above objects together with numerous other objects, features and advantages, which will be evident from the below description of the present invention are, according to a third aspect of the present invention, obtained by an intermediate product comprising an elongated piece of a fat absorbing and optionally and preferably also moisture and water absorbing material for being further processed into a pelt board bag used in combination with and applied externally to a pelt board for the tanning and drying of a pelt applied externally to the pelt board bag, said piece comprising:

i) opposite first and second ends, said first end constituting a narrow top end and said second end constituting a broader bottom end, ii) a pair of fold lines provided with slits, oblong apertures, embossings, score lines, folds or combinations thereof and extending substantially between said first end and said second for allowing said piece to be folded and establish a pair of oppositely positioned and substantially coextensively extending sheets capable of defining in a first state a flat two-layer structure and in a second state a basically tubular state having an inner perimeter varying from said first narrow end to said broader second end, and iii) said piece having a region provided with slits, oblong apertures, embossings, score lines, folds or combinations thereof allowing said region to be expanded at least in one direction longitudinally or transversely.

The intermediate product according to the third aspect is used for manufacturing a pelt board bag according to the first aspect by performing a subsequent folding of the flat singe layered intermediate product.

The above objects together with numerous other objects, features and advantages, which will be evident from the below description of the present invention are, according to a fourth aspect of the present invention, obtained by a method of manufacturing a pelt board bag, said pelt board bag being intended for use in combination with and applied externally to a pelt board for the tanning and drying of a pelt applied externally to the pelt board bag, said method comprising providing a fat absorbing and optionally and preferably also moisture and water absorbing material, said method comprising the steps of:

i) cutting an elongated piece of said material comprising opposite first and second ends, said first end constituting a narrow end constituting a top end and said second end constituting a broader bottom end, ii) making slits, oblong apertures, embossings, score lines, folds or combinations thereof in said piece along a pair of folding lines substantially extending between said first end and said second end, iii) making slits, oblong apertures, embossings, score lines, folds or combinations thereof in a region of said piece allowing said region to be expanded at least in one direction longitudinally or transversely, and iv) folding said elongated piece of material along said folding lines, thereby establishing a pair of oppositely positioned and substantially coextensively extending sheets capable of defining in a first state a flat two-layer structure and in a second state a basically tubular state having an inner perimeter varying from said first narrow end to said broader second end.

In the above fourth aspect the steps i), ii) and iii) are preferably made in one single moment by using a sheet cutting and stamping machine, resulting in the intermediate product of the third aspect. Subsequently, the step iv) may be performed in a folding machine which together with the cutting machine may form a pelt board bag manufacturing plant. The method according to the fourth aspect thus is suitable for manufacturing the pelt board bag according to the first aspect.

Figure 2A:
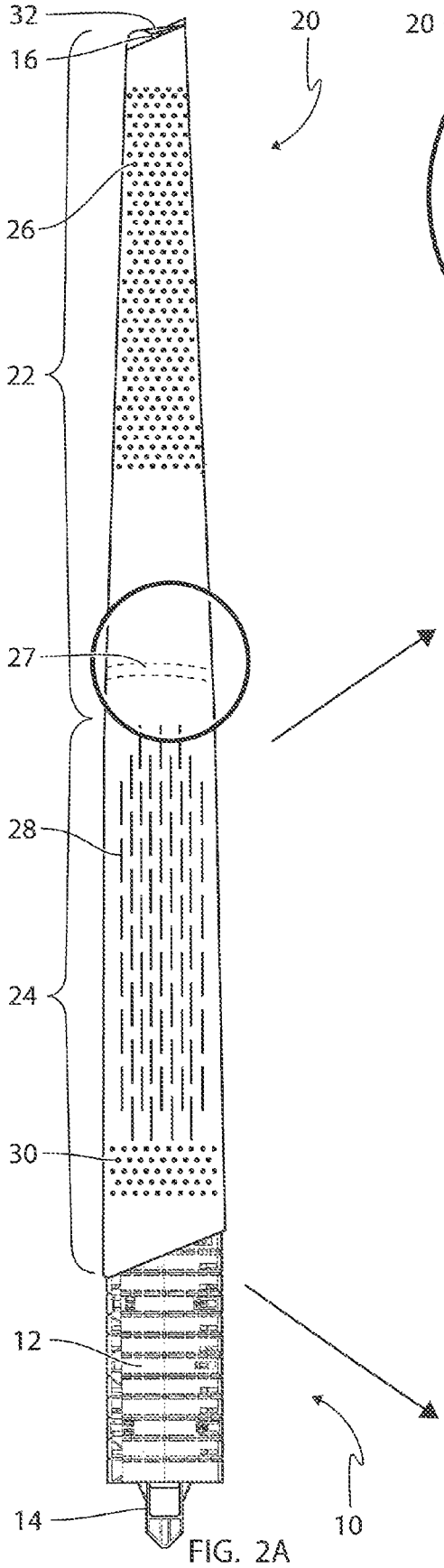
Figure 2C:
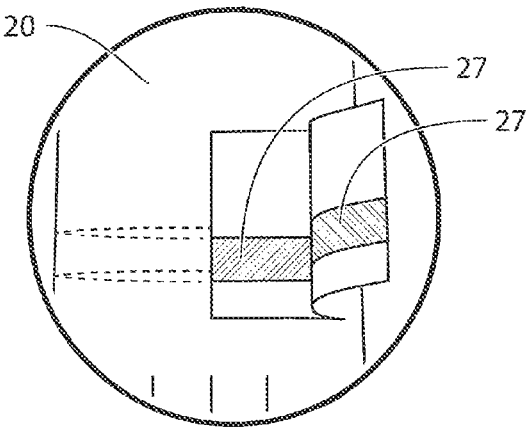
Figure 2B:
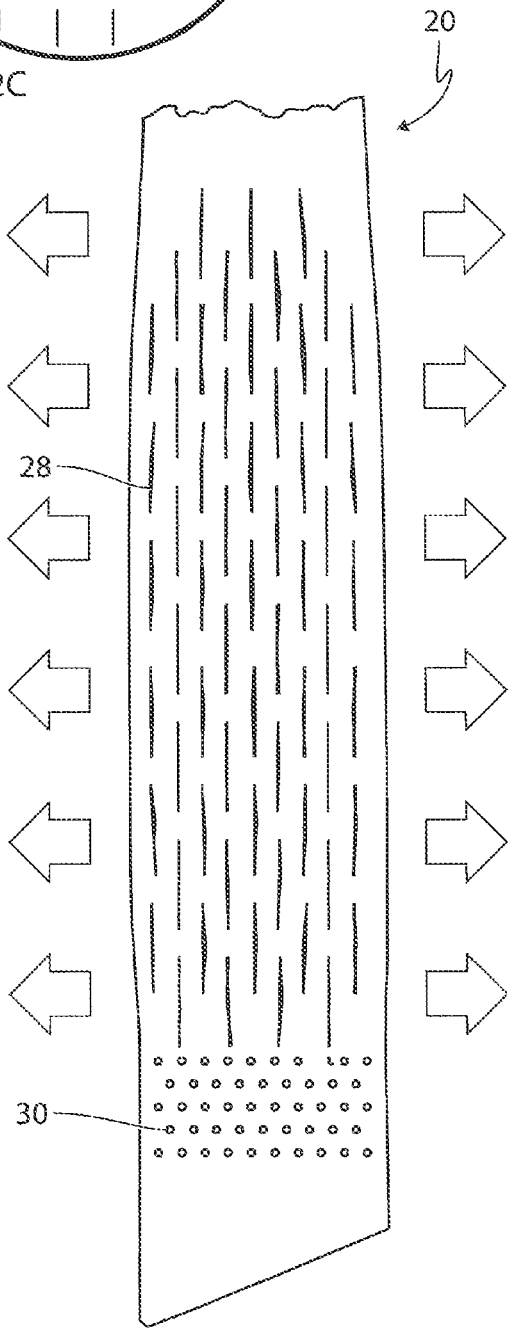
Figures 3A, 3B, 3C:
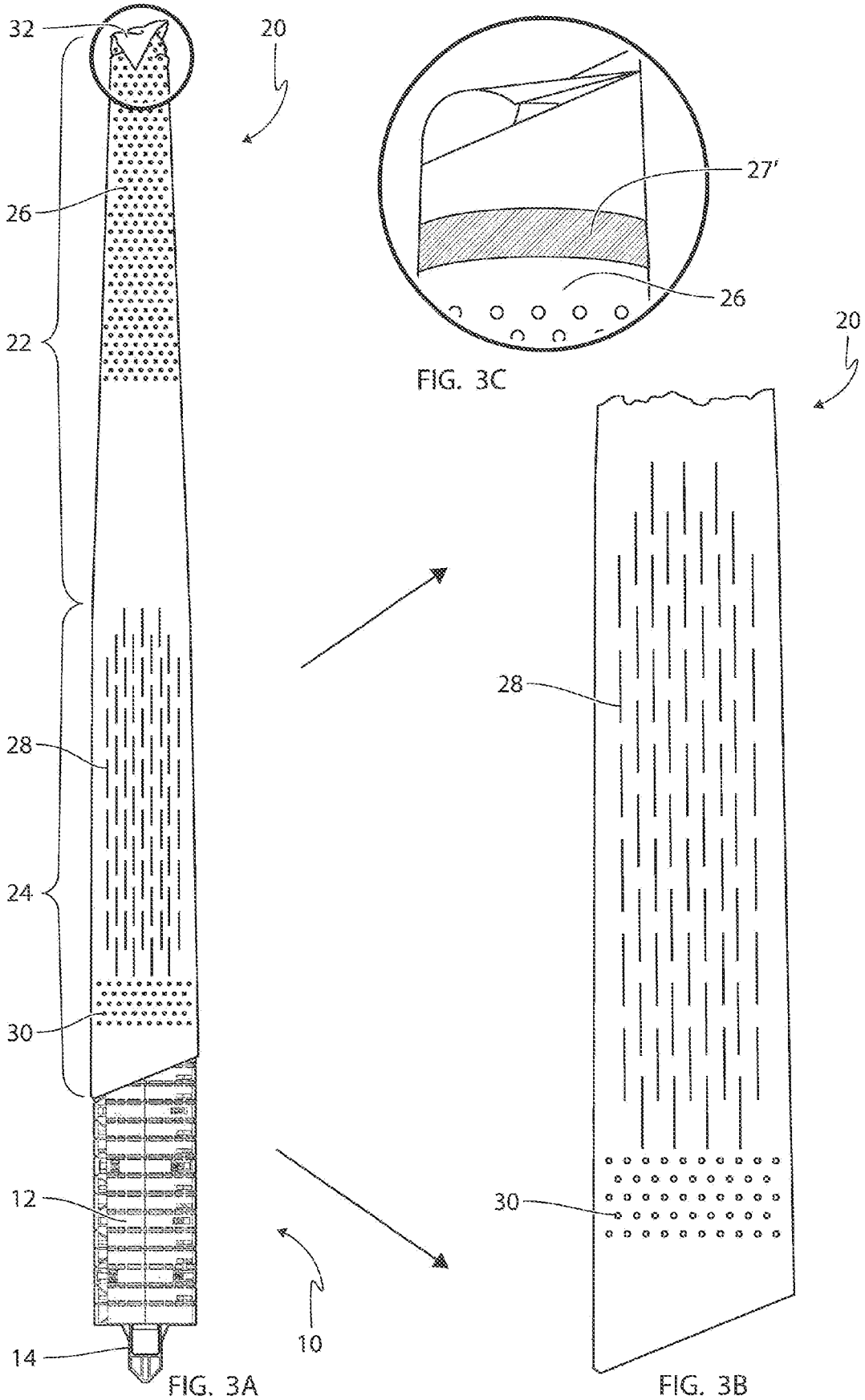
Figure 4A:
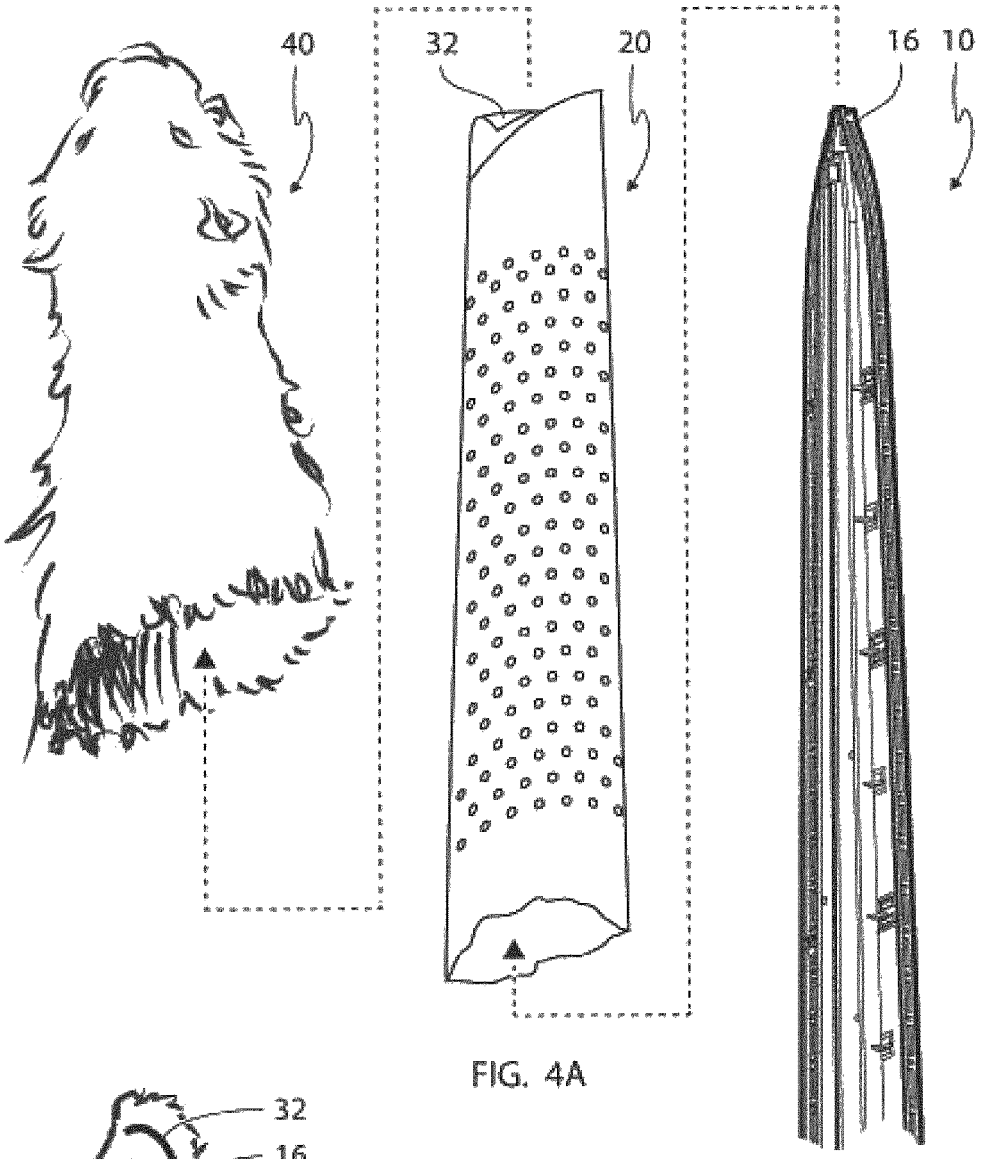
Figure 4B:
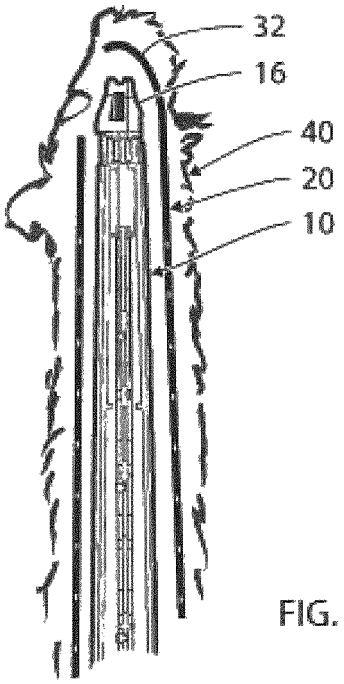
Figure 5A:
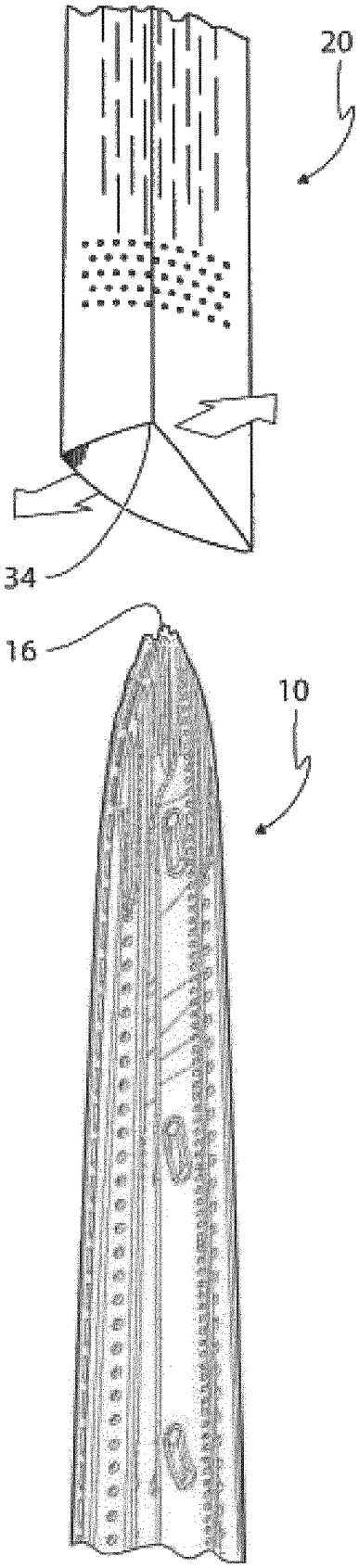
Figure 5B:
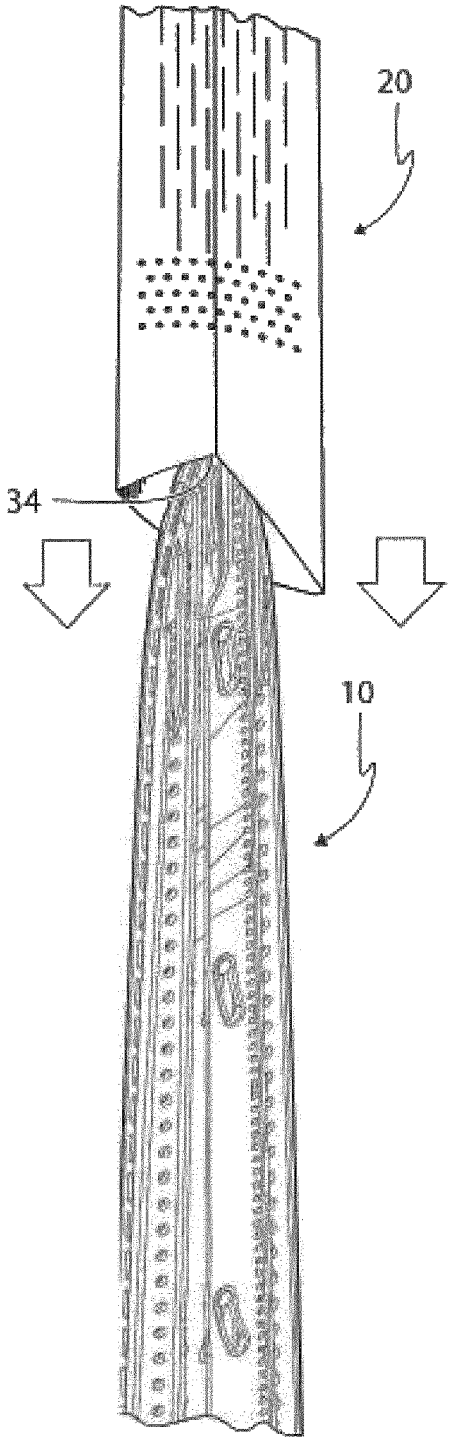
Figure 6A:
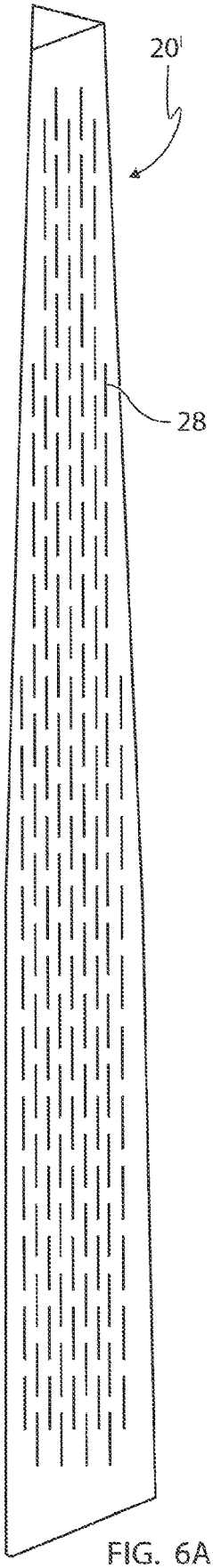
Figure 6B:
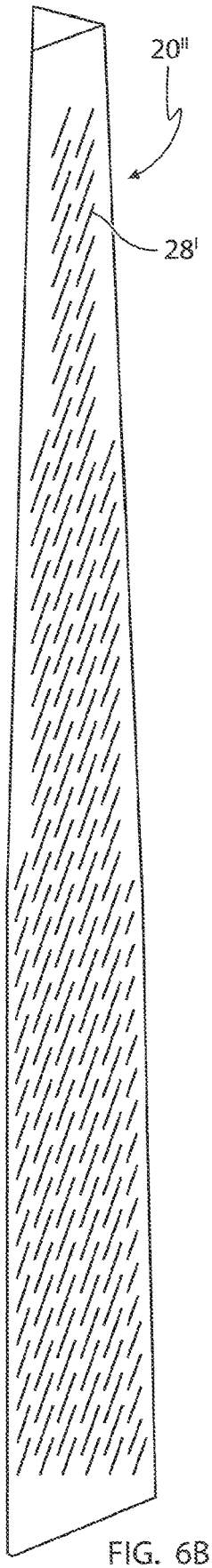
Figure 6C:
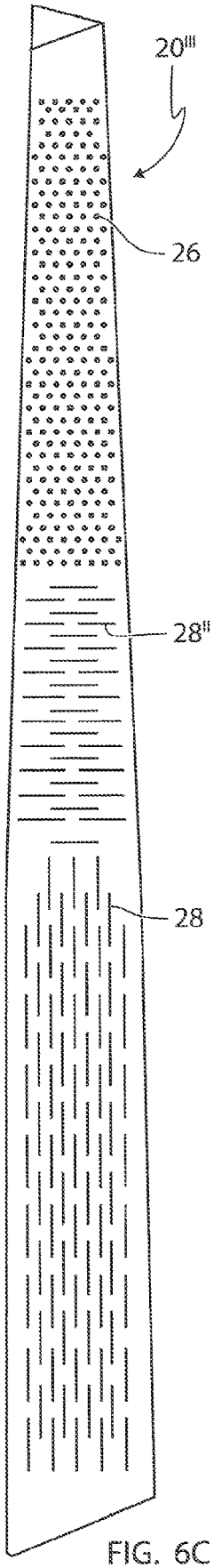
Figure 8A:
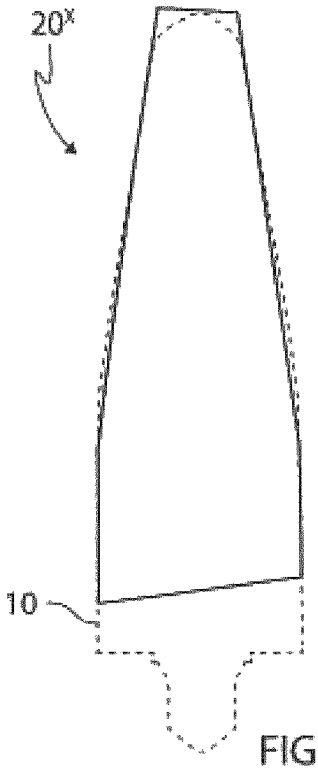
Figure 8B:
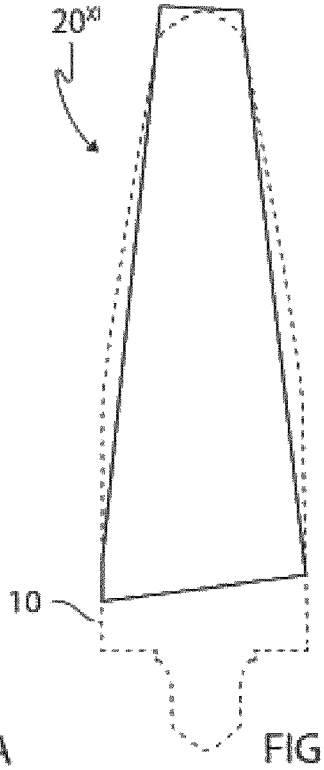
Figure 8C:
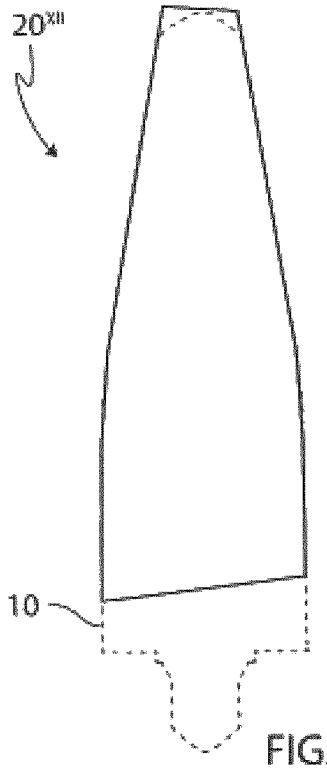
Figure 8D:
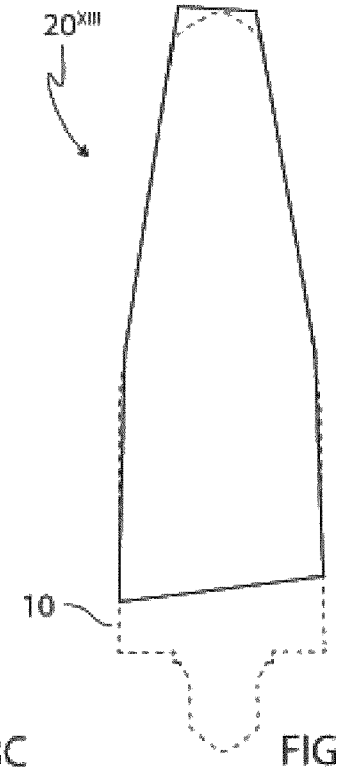
Figure 9A:
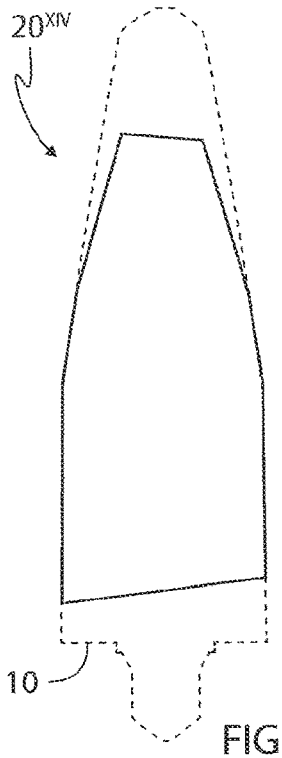
Figure 9B:
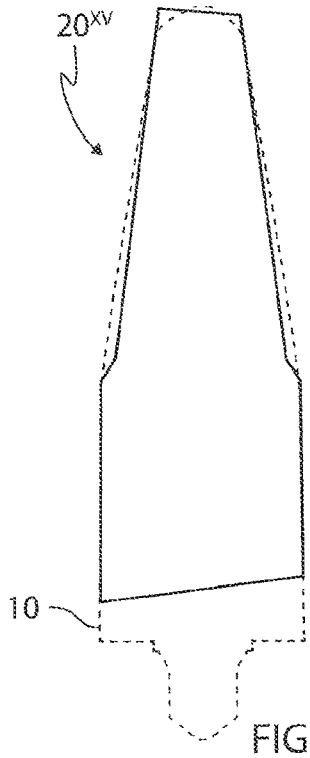
Figure 9C:
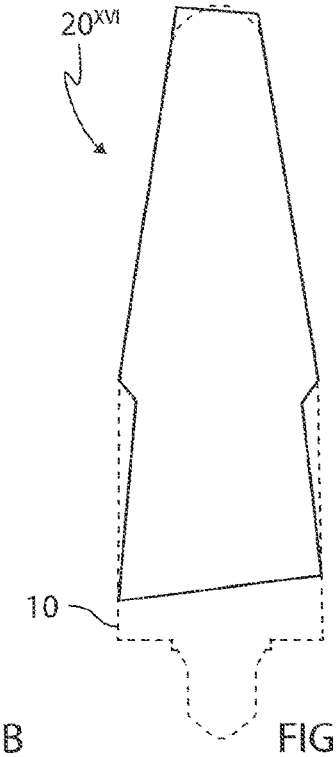
Figure 9D:
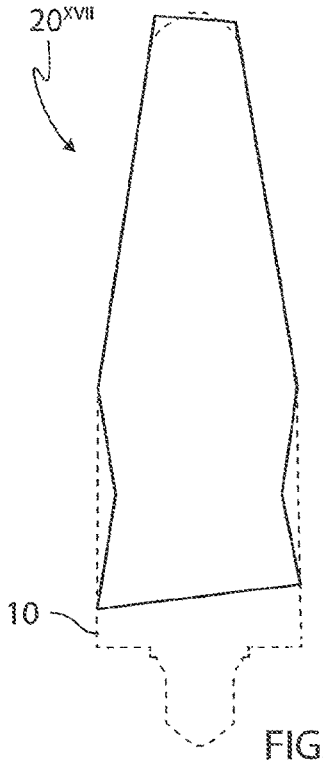
Figure 9E:
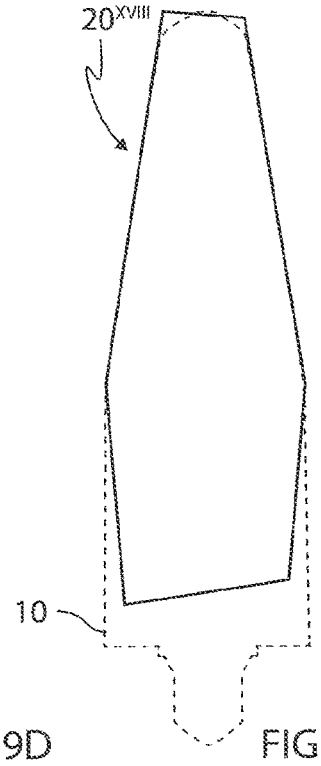
Figure 10A:
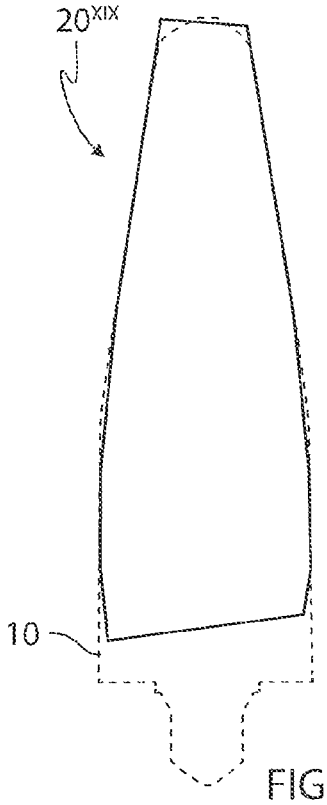
Figure 10B:
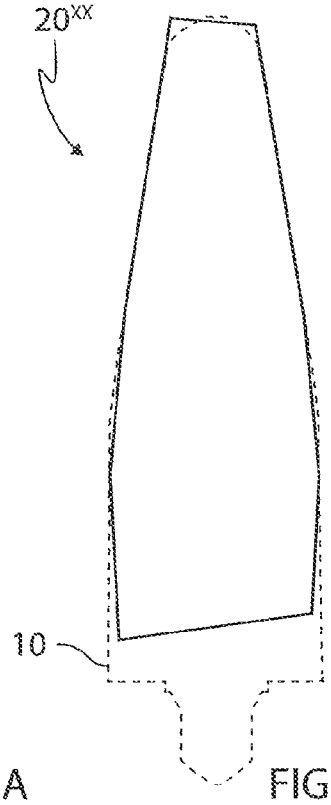
Figure 11A:
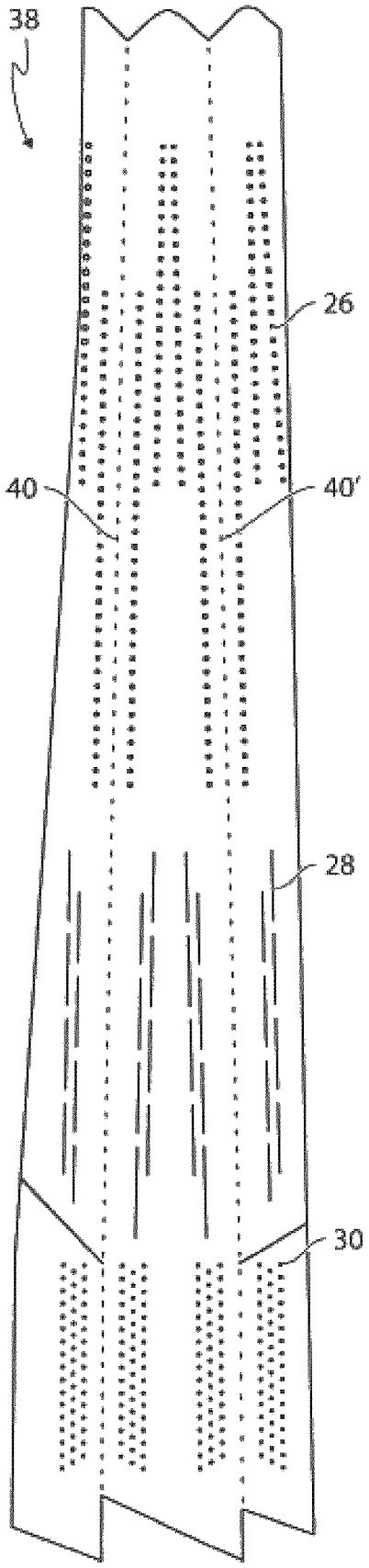
Figure 11B:
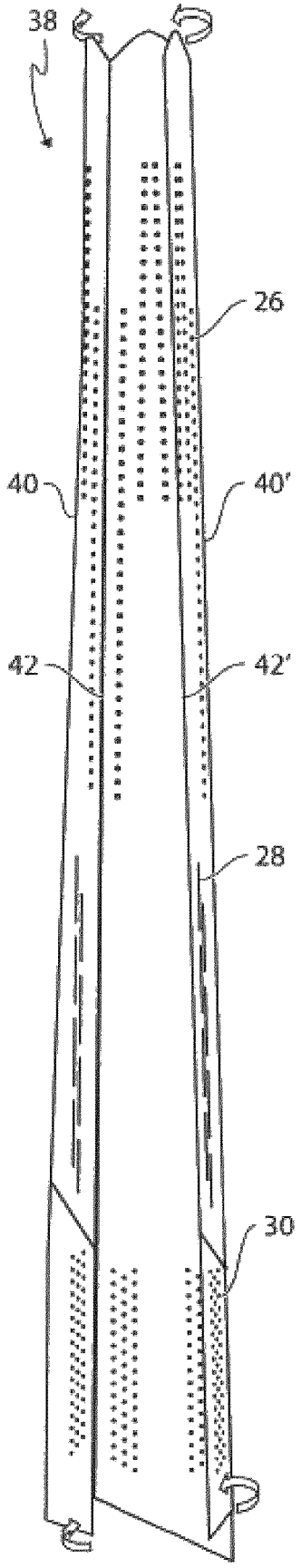
Figure 11C:
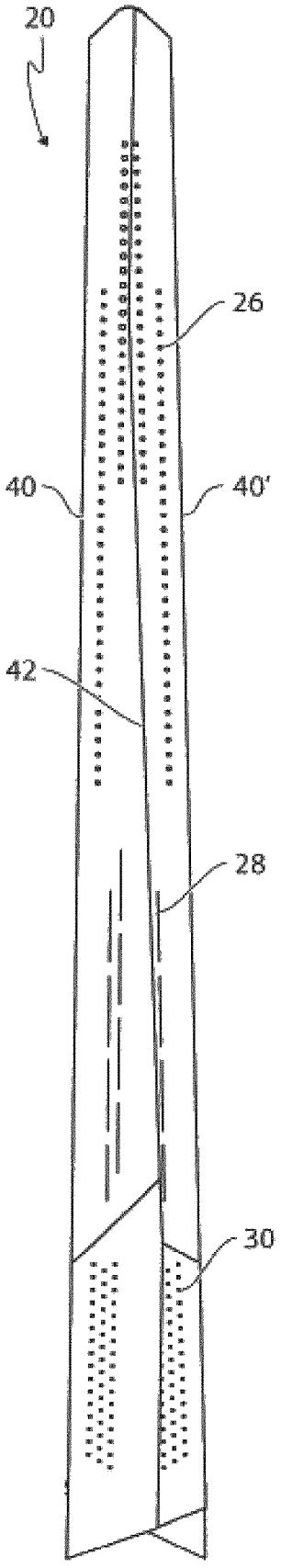
Figure 12:
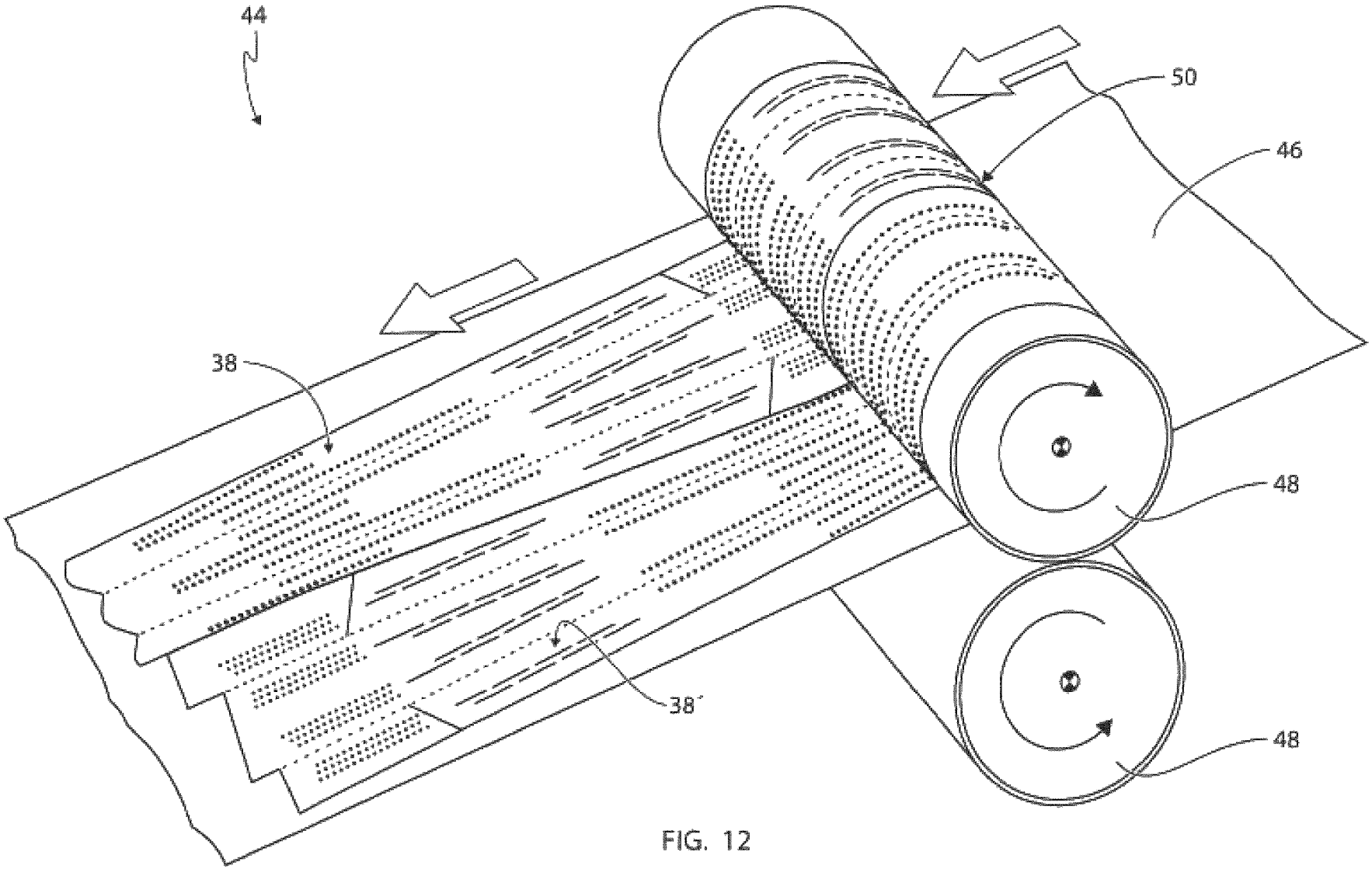
Figure 13A:
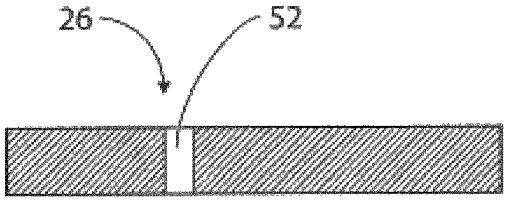
Figure 13B:
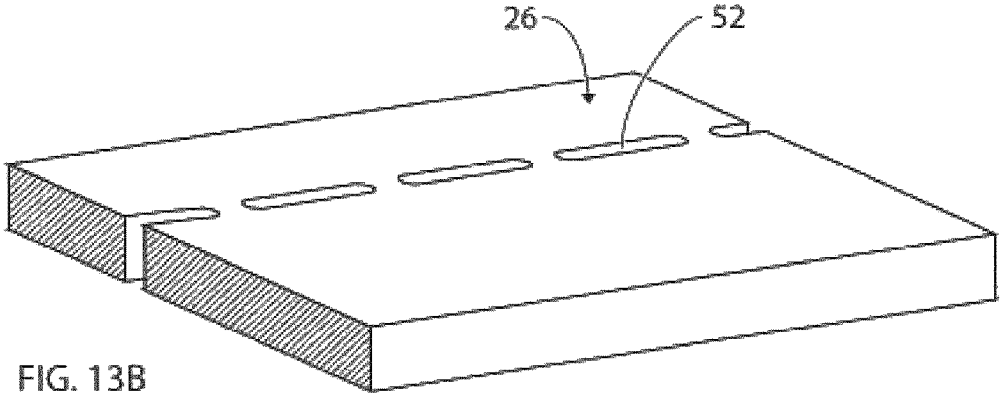
Figure 14A:
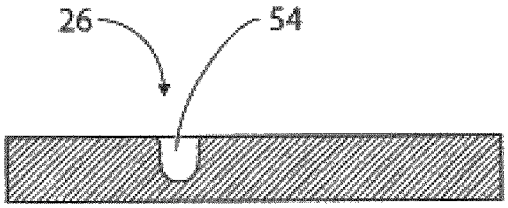
Figure 14B:
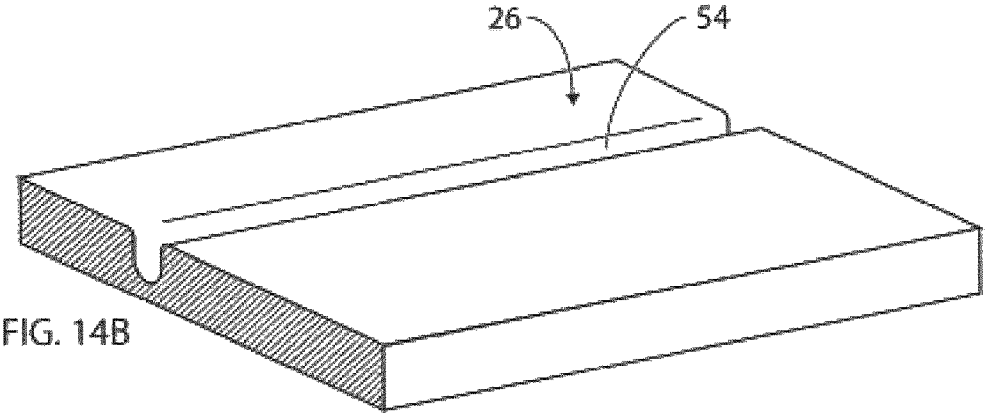
Figure 15A:
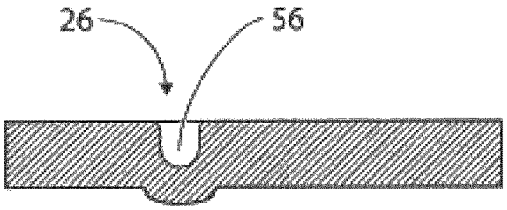
Figure 15B:
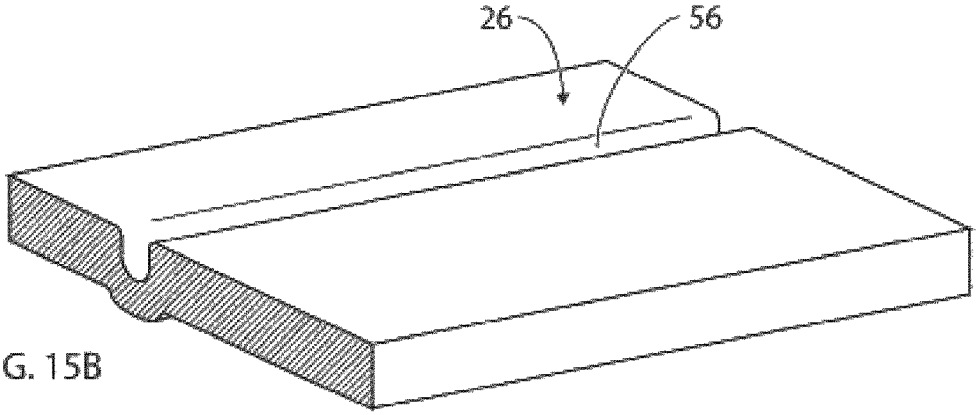
Figure 16A:
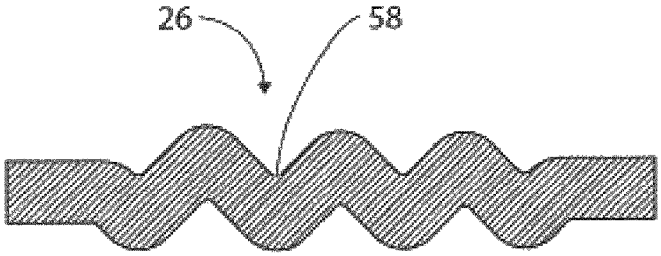
Figure 16B:
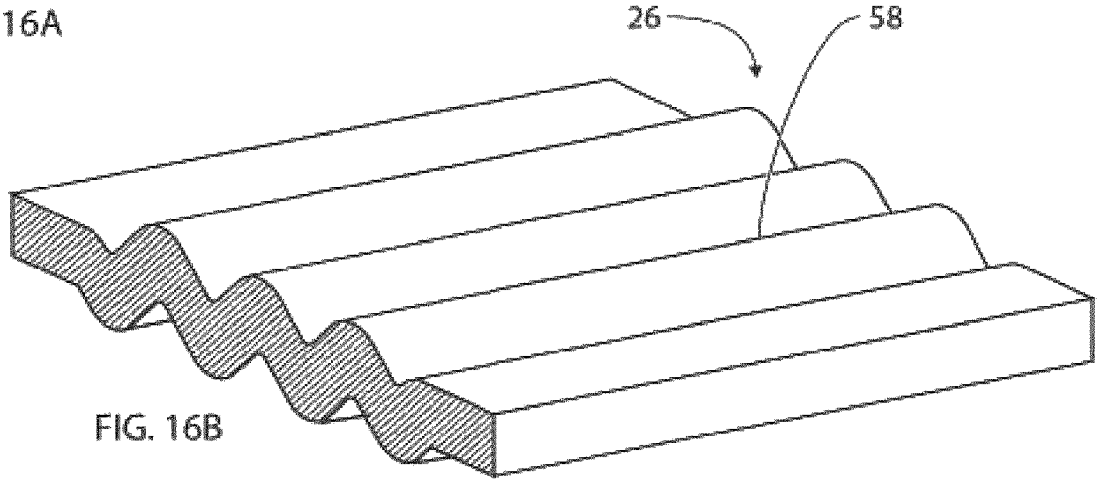

The present invention is now to be further described with reference to the drawings, in which:

FIG. 1 shows in an elevational and schematic view a pelt board and a first embodiment of a pelt board bag according to the present invention shown from its opposite facial sides, FIGS. 2A, 2B and 2C are schematic views illustrating the first embodiment of a pelt board bag also shown in FIG. 1 applied to the pelt board also shown in FIG. 1 and in FIG. 2B illustrating a specific feature of the pelt board bag, namely the feature of allowing the pelt board bag to adjust its configuration to the pelt board, FIGS. 3A, 3B and 3C are schematic views similar to the views of FIGS. 2A, 2B and 2C respectively, illustrating an improper positioning of the pelt board bag relative to the pelt board in which position no adjustment of the configuration of the pelt board bag is taking place, FIG. 4A is a schematic view illustrating the sequence of applying firstly the pelt board bag to the pelt board and secondly applying the pelt to the pelt board bag previously applied to the pelt board, FIG. 4B is a schematic and vertical sectional view illustrating on advantageous feature of the pelt board bag allowing for a closing off of the mouth opening of the pelt, FIGS. 5A and 5B are schematic views illustrating a further advantageous feature of the pelt board bag according to the present invention of simplifying the technique of applying the pelt board bag to the pelt board, FIGS. 6A, 6B and 6C are schematic views of an alternative embodiments of the pelt board bag according to the present invention, FIGS. 7A-7J are schematic views similar to the view of FIG. 1 illustrating modified or alternative embodiments of the pelt board bag according to the present invention and schematically illustrating its advantageous ability to adjust its configuration to the pelt board to which the pelt board bag is applied, FIGS. 8A-8D are schematic views illustrating alternative embodiments or configurations of the pelt board bag according to the present invention, FIGS. 9A-9E are further alternative embodiments or configurations of the pelt board bag according to the present invention, FIGS. 10A and 10B are still further alternative embodiments or configurations of the pelt board bag according to the present invention, FIGS. 11A-11C are schematic views illustrating the folding process of the intermediate product into a pelt board bag according to the present invention, FIG. 12 is a schematic view of a cutting and stamping machine used for producing the intermediate product according to the present invention, FIGS. 13A and 13B are schematic illustrations of slits according to the present invention, FIGS. 14A and 14B are schematic illustrations of scores according to the present invention, FIGS. 15A and 15B are schematic illustrations of embossings according to the present invention, and FIGS. 16A and 16B are schematic illustrations of folds according to the present invention.

On the left-hand side of FIG. 1, a pelt board 10 is shown, which pelt board constitutes a pelt board implemented in accordance with the teachings described in the applicant's previously filed international patent application, application number PCT/EP2015/056431, in which a detailed description of the pelt board is to be found. However, a few essential technical features are to be mentioned in the present context.

The pelt board 10 is basically composed of three components, namely two identically configured convex plates, one of which is shown in FIG. 1 and designated the reference numeral 12, which is assembled to an identical rear plate by the cooperation with a central rod-shaped element having at its lower end a protruding connector element 14.

The pelt board 10 is as such an expandable or collapsible pelt board in which the two faces are shifted sidewise relative to one another for establishing an expanded state shown in FIG. 1 in which a pelt board and a pelt is to be applied. In FIG. 1, two dimensions, L1 and L2 are indicated, which dimensions in the presently preferred embodiment of the pelt board 10 are 492 mm and 900 mm, respectively, as the length L2 is a standard measure determined by the standard established by Kopenhagen Fur A/S, whereas the length L1 is determined in accordance with empirical experiments performed by the applicant company.

In FIG. 1 is further shown a first embodiment of a pelt board bag, which is designated the reference numeral 20 in its entirety. The first embodiment 20 of the pelt board bag is basically construed by a conical structure composed of a top part 22 and a bottom part 24 as the top part 22 has a higher taper than the lower part 24 for providing a configuration partly resembling the top section of the pelt board 10. From the drawings FIG. 1 it is evident that the top part 22 of the pelt board bag 20 does not lengthwise correspond to the top section of the length L2 of the pelt board 10 since the length of the top part 22 of the pelt board bag 20 is indicated by L5 and is in the presently implemented embodiment of the pelt board bag 20 constituted by a length of 831 mm.

The lower part 24 of the pelt board bag 20 has a total length L3+L4 of 521 mm. The imaginary borderline between the lengths L3 and L4 of the bottom part 24 is constituted by the inner circumference of the bag being 250 mm, which corresponds to the standard width of the pelt board 10 in its expanded state as defined by the standard of Kopenhagen Fur A/S. As will be readily understood from the drawings FIG. 1, the conical pelt board bag 20 is due to its minor width as compared to the width of the expanded pelt board 10 of a structure which will be positioned tightly fixed to the pelt board 10 and necessitates, as will be described below with reference to FIGS. 2A, 2B and 2C, a kind of adjustment of the configuration of the pelt board bag for allowing the pelt board bag to be applied in its intentional position relative to the pelt board.

As is evident from FIG. 1, the pelt board bag 20 further exhibits in its top part 22 a apertured or perforated upper end section, which is positioned in an area to be covered by the front legs and the adjacent part of the leg which is applied to the pelt board having a pelt board bag 20 positioned between the pelt board 10 and the pelt. One of the apertures of the apertured or perforated section of the top part 22 is designated the reference numeral 26.

Below the apertured or perforated section of the top part 22 of the pelt board bag 20, a non-perforated section is provided. The lower part 22 of the pelt board bag 20 is in its major extent provided with lengthwise oriented cuts, one of which is designated the reference numeral 28.

The longitudinally extending slits 28 serve, as will be described below, the purpose of allowing the pelt board bag 20 to accommodate a configuration or adjust its transversal dimension to the pelt board 10 and in doing so providing a tight fit relative to the pelt, which ensures firstly a proper fixation of the pelt board bag 20 relative to the pelt prior to applying the pelt to the outside of the pelt board bag 20, and further ensures that the pelt board bag is kept in position on the pelt board 10 after the pelt has been dried and is removed from the pelt board bag which simplifies the removal of the pelt board bag after the tanning and drying operation has been completed as is in itself well-known in the art.

Below the longitudinal extending slits 28, an aperture or perforated section is provided in the lower part 24 of the pelt board bag 20, which aperture or perforated section has a single aperture designated the reference numeral 30.

The pelt board bag 20 shown in FIG. 1 further exhibits two distinct and highly advantageous geometrical features, as the configuration of the uppermost end of the conical top part 22 of the pelt board bag 20 as the two sides of the pelt board bag are of different lengths providing an extension flap designated the reference numeral 32 and constituted by the longer side of the pelt board bag. The opposite end of the pelt board bag exhibits a notch 34 as the one side of the pelt board bag 20, which side provides the flap 32 is cut so as to diminish the bottom length of the pelt board bag relative to the length of the opposite side of the pelt board bag. The advantageous features of the flap 32 and the notch 34 will be described below.

In FIG. 2A, the first embodiment 20 of the pelt board bag is shown applied to the pelt board 10 in the intentional position of the pelt board bag 20 relative to the pelt board 10 as the outermost top end 16 of the pelt board 10 is exposed at the upper end of the pelt board bag, however, covered below the turned over flap 32. Since the width of the pelt board bag 20—except for the lowermost section of a length of L3—is narrower than the width of the pelt board 10, the pelt board bag exhibits the advantageous feature of allowing the pelt board bag to adjust its width or dimensions to the pelt board to which it is applied. This feature is shown schematically and somewhat exaggerated in FIG. 2B in which the spreading of the upper section of the lower part 24 of the pelt board bag 20 is shown as the longitudinal slits 28 are caused to be opened providing a widening of the upper section of the lower part 24 of the pelt board bag 20 for accommodating the size and the configuration of the pelt to the wider size and dimensions of the pelt board 10. In FIG. 2A and further, in an enlarged sectional view of FIG. 2C, a further feature of the first embodiment 20 of the pelt board bag according to the present invention is shown, which feature serves to define a specific positioning of the pelt board bag relative to the pelt board 10 by the provision of a strengthening band 27 provided as a layer or a glued reinforcing layer applied internally in the pelt board bag material as is illustrated in FIG. 2C. The strengthening band 27 is provided at a position along the conical part or top part 22 of the pelt board bag for defining the specific and intentional positioning of the pelt board bag 20 relative to the pelt board 10 and allowing the intentional proper expansion of the upper section of the lower part 24 of the pelt board bag 20 by the presence of the longitudinal slits 28.

Apart from the ability of adjusting the transversal dimensions of the pelt board bag 20 relative to the pelt board 10, the longitudinal slits 28 also serve the purpose of allowing air to be vented through the slits similar to the well-known venting of air through the aperture or perforation 26 and 30, respectively, of the pelt board bag 20. The pelt board bag may as such be made from any appropriate material and configured in accordance with the intentional application such as the example described above, the intentional use in combination with a Kopenhagen Fur A/S standardized pelt board and the materials used for the pelt board bag may preferably be paper or cardboard or combinations thereof or paper material including polymer fibers such as woven or non-woven polyethylene or polypropylene fibers.

The paper based pelt board bag is evidently serving the purpose of firstly drawing residual fat from the inner side of the pelt applied to the pelt board bag and in addition allowing water to be absorbed or transmitted and evaporated through the apertures or perforations and additionally the slits 28 described above. Provided the pelt board bag is made from a paper based material, the bag is evidently of the disposable kind, however, alternative material based on natural or synthetic fibers such as woven polyester or polypropylene fibers or natural cotton or similar fibers may be used for providing a non-disposable bag.

Provided the pelt board bag 20 is improperly positioned or applied to the pelt board 10 without stretching the pelt board bag properly downwardly towards the lower end of the pelt board, the pelt board bag may be applied as shown schematically in FIG. 3A in which configuration the pelt board bag provides a somewhat crumbled top end and reduces the intentional functionality of the vertical slits 28, which are—as is evident from FIG. 3B—not expanded for adjusting or adapting the configuration of the pelt board bag to the pelt board and failing to provide the increased air outlet area by the opening of the slits as is illustrated in FIG. 2B. In FIG. 3C, an enlarged view similar to the view of FIG. 2C illustrates an alternative location of the reinforcing band 27' at a position along the conical part or the top part 22 of the pelt board bag 20, as in FIG. 3C, the reinforcing band 27' is positioned above the aperture or perforated section of the top part 22 and applied as an external coating. In FIG. 3A, it is contemplated that the person positioning the pelt board bag 20 on the pelt board 10 is not utilising the feature of the strengthening band 27', rather simply in an incorrect application of the pelt board bag simply slips the bag onto the pelt board 10 without forcing the pelt board bag to its intentional position, in which the strengthening band 27' prevents any further downward motion of the pelt board bag 20 relative to the pelt board, unless an excessive force is applied to the pelt board bag 20, which causes a tearing apart of the whole pelt board bag.

In FIG. 4A, the pelt board 10, the pelt board bag 20 and a pelt 40 is shown and a dotted line having a directional arrow indicates the intentional order of applying the pelt board bag 20 to the pelt board 10 and when applying the pelt 40 to the properly positioned pelt board bag 20 as is shown in FIG. 2A.

In FIG. 4B is shown a detail of the flap 32 of the pelt board bag 20, which flap—as is also shown in FIG. 2A—is turned over covering the uppermost end of the pelt board 10 and in doing so, closes off the mouth opening of the pelt 40 in order to prevent that a major part of the venting air which is forced into the interior of the pelt board bag 20 through the bottom connector 14 of the pelt board 10 and guided up through the interior of the pelt board 10 escapes through the mouth of the pelt 40 rather than being forced out through the apertures of the pelt board and through the intended air passages established by the apertures or perforations 26 and 30 and the expanded longitudinal slits 28.

In FIGS. 5A and 5B, the pelt board 10 and the first embodiment of the pelt board bag 20 are shown illustrating an advantageous feature of the presence of the notch 34 provided in the pelt board bag at its lower end opposite the flap 32. The notch is as such provided in the one side of the pelt board bag and allows for an easy separation of the two opposite sheets of the pelt board bag 20 e.g. by simply pressing lightly at the edges of the pelt board bag 20.

After the slight separation of the two sheets of the pelt board bag 20 from one another—as illustrated in FIG. 5A—the pelt board bag 20 is pushed down on the expanded pelt board 10 as is illustrated in FIG. 5B or alternatively the collapsed or non-expanded pelt board 10 (not shown in the drawings) and indicated by two further arrows as the notch in the one sheet of the pelt board in FIGS. 5A and 5B—the sheet facing towards the viewer—allows for the ready and easy positioning of the pelt board bag 20 above and contacting the pelt board bag 20 with the uppermost end 16 of the pelt board 10.

In FIGS. 6A, 6B and 6C, a second, a third and a fourth embodiment of the pelt board bag according to the present invention is shown designated the reference numerals 20', 20" and 20'", respectively. In FIG. 6A-6C and in the further figures, components or elements identical to previously described components or elements, respectively, are designated the same reference numerals as previously used and no specific description of the component or element in question is presented except for specific purpose of understanding of a further functionality of the component or element in question, whereas components or elements corresponding to or having similar functions as previously described components or element, respectively, are designated the same reference numeral as previously used, however, added a marking for identifying the difference in geometrical configuration.

The second, third and fourth embodiment 20', 20" and 20", respectively, of the pelt board bag according to the present invention shown in FIGS. 6A, 6B and 6C, respectively, differ from the above-described first embodiment 20 in that the bags are provided with an increased number of elements allowing for the modification or change of configuration of the pelt board bag for allowing the pelt board bag to be tightly mounted on a corresponding pelt board, being an expanded or collapsed pelt board.

In FIG. 6A, the entire outer surface and similarly the opposite surface of the pelt board bag 20' is provided with an increased number of longitudinal slits 28 covering the entire outer surface of the pelt board bag and similarly the opposite side or the opposite sheet of the pelt board bag simply allowing for the provision of expandable areas of the entire pelt board bag for accommodating the configuration of the pelt board bag 20' to the configuration of the pelt board with which the pelt board bag is to be used and at the same time providing the air venting capability at the entire structure of the pelt board bag. The pelt board bag 20' is—compared to the pelt board, an expanded pelt board or a collapsed pelt board—an undersized pelt board bag.

Whereas the slits 28 shown in the first embodiment 20 described above and also in the second embodiment 20' described with a reference to FIG. 6A, are extending longitudinally allowing only for the expansion transversely of the sheets of the pelt board bag or the specific areas of the pelt board bag in question, the third embodiment 20' of the pelt board bag shown in FIG. 6B is provided with modified slits extending diagonally relative to the longitudinal axis of the pelt board bag and being provided on both sides of the pelt board bag. The diagonal slits 28' allow for an expansion due to the separation of the sheet material adjacent the slits, in the longitudinal direction and also in the transversal direction of the pelt board bag 20".

It is of course evident that the provision of the longitudinally extending slits and the diagonally extending slits shown in FIGS. 6A and 6B, respectively, may be dedicated to specific areas of the pelt board bag rather than being provided at the entire surface of the two sheets of the pelt board bags. Furthermore, the diagonally extending slits 28' may be modified into having the opposite diagonally extending orientation or be combined with longitudinally extending or transversally extending slits.

In FIG. 6C, the fourth embodiment 20'" of the pelt board bag according to the present invention is shown including in its top part apertures identical to the apertures described above with a reference to FIG. 1 and at its lower part and at the lower section of the top part of the pelt board bag corresponding to the non-apertured or non-perforated area of the top part of the pelt board bag 20 shown in FIG. 1, the fourth embodiment 20''' of the pelt board bag according to the present invention is provided with transversal slits 28'' serving the purpose of allowing the pelt board bag 20''' to be slightly extended longitudinally due to the separation of the slits 28''. In the fourth embodiment 20''' of the pelt board bag according to the present invention shown in FIG. 6C, the entire lower part of the pelt board bag is provided with slits extending longitudinally, i.e. slits 28 serving the same purpose as the slits described above with reference to FIG. 1 and also shown in FIG. 6A.

Figures 7A, 7B, 7C:
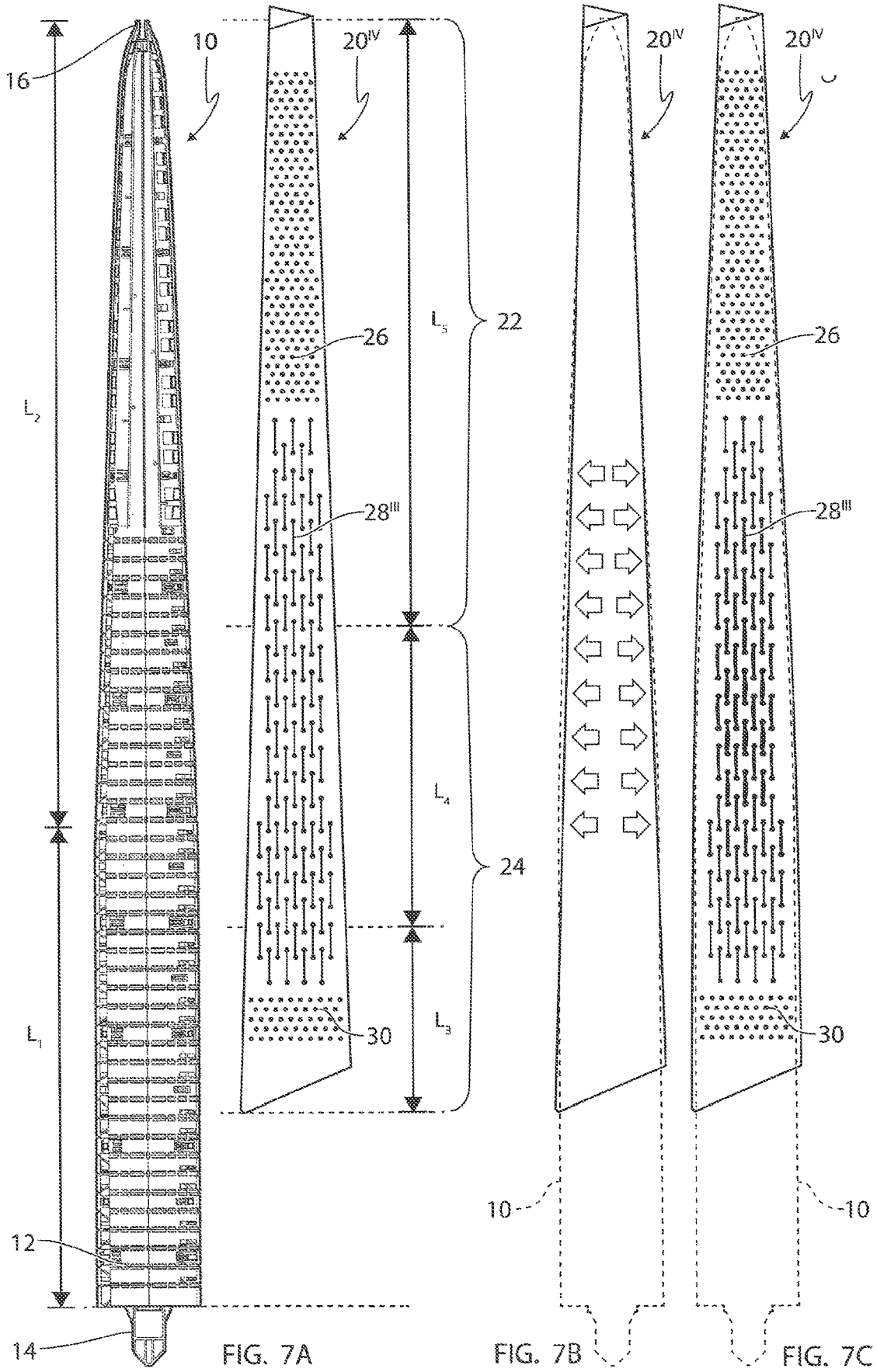

In FIGS. 7A, 7B and 7C, a further or fifth embodiment of the pelt board bag according to the present invention is shown designated the reference numeral $\mathbf{20}^{iv}$. The fifth embodiment $\mathbf{20}^{iv}$ of the pelt board bag according to the present invention differs from the above-described first embodiment 20 shown in FIG. 1 in that the longitudinally extending slits 28''' are also provided covering the major part of the lower part 24 of the pelt board and also the lower section of the top part 22 of the pelt board. In addition, the slits are provided with circular end holes which are believed to provide a tear preventing feature as the circular end openings of the slits prevent the material from being torn at the time of separating the material adjacent a specific slit.

In FIG. 7B, the fifth embodiment $\mathbf{20}^{iv}$ of the pelt board according to the present invention is shown schematically overlaid the expanded pelt board 10 shown in the left-hand part of FIG. 7A, and from this schematic overlay view, it becomes evident how the pelt board bag $\mathbf{20}^{iv}$ has to be widened within the area provided with the slits 28''' and above the section of the lengths L3. The fifth embodiment $\mathbf{20}^{iv}$ further differs from the above-described twin conical bags shown in all previous discussed FIGS. 1-6C in that the bag is a bag having a single taper which, from the view of producing the bag, makes the assembly more easy and also reduces waste of material when cutting the two sides of the bag from the material, which is preferably paper or cardboard-like material.

In FIG. 7C, a view similar to the view in FIG. 7B is presented illustrating the actual whitening of the pelt board bag $\mathbf{20}^{iv}$ in the central section as indicated by arrows in FIG. 7B.

Figure 7D:
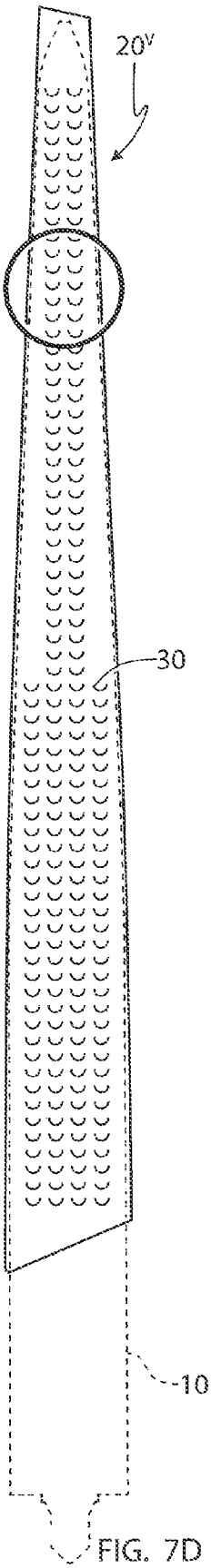
Figure 7E:
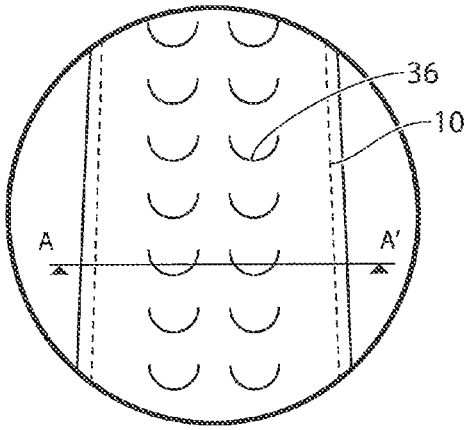
Figure 7F:
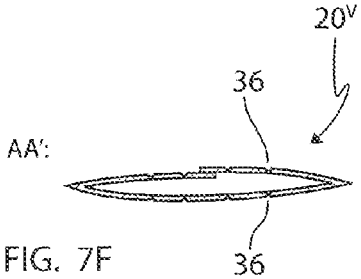

In FIG. 7D, a sixth embodiment $\mathbf{20}^{V}$ of the pelt board according to the present invention is shown schematically overlaid the expanded pelt board 10 shown in dotted line in the lower left hand part of FIG. 7D. The pelt board bag $\mathbf{20}^{V}$ is as distinct from the above described embodiments, in which slits or cuts are provided through the paper material of the pelt board bag provided with a plurality of embossings or score lines 36 allowing for the tearing of the material along the embossings or the score lines, as the pelt board bag is to be expanded as it is positioned on the pelt board 10. In FIG. 7E, an enlarged sectional view of a segment of the upper conical part of the pelt board bag $\mathbf{20}^{V}$ is shown, in which the marking AA' indicates a sectional line, along which the section AA' shown in FIG. 7F is provided. In FIG. 7F, the embossings or score lines are shown indicating the lack of any puncturing or aperturing of the paper material of the pelt board bag $\mathbf{20}^{V}$.

Figure 7G:
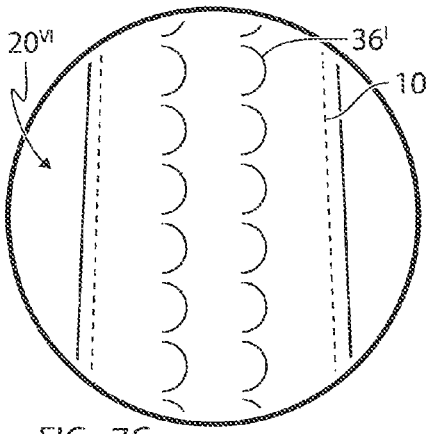

In FIG. 7G, an alternative seventh embodiment $\mathbf{20}^{VI}$ is shown, in which the embossings or score lines 36' are arranged perpendicularly relative to the orientation of the score lines 36 shown in FIGS. 7D, 7E and 7F.

Figure 7H:
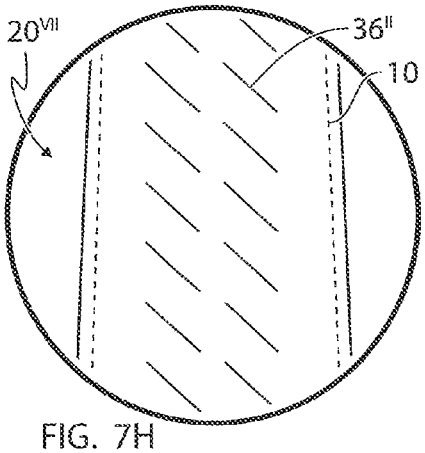
Figure 7I:
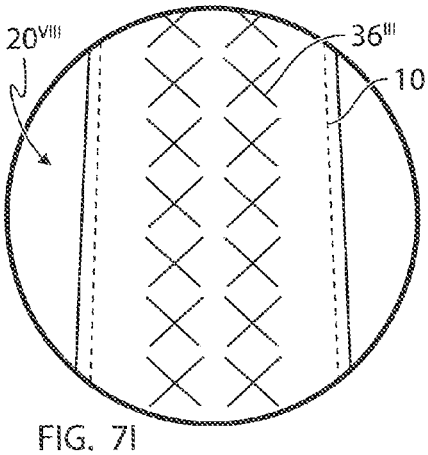

In FIG. 7H, an eighth embodiment $\mathbf{20}^{VII}$ of the pelt board bag according to the present invention is shown, in which the embossings or score lines 36'' are constituted by angularly orientated linear segments and in a further or ninth embodiment $\mathbf{20}^{V111}$ shown in FIG. 7I, the embossings or score lines $\mathbf{36}^{III}$ are constituted by crossed linear segments serving to be torn up as apertures or linear slits, as the pelt board bag $\mathbf{20}^{VIII}$ is expanded.

Figure 7J:
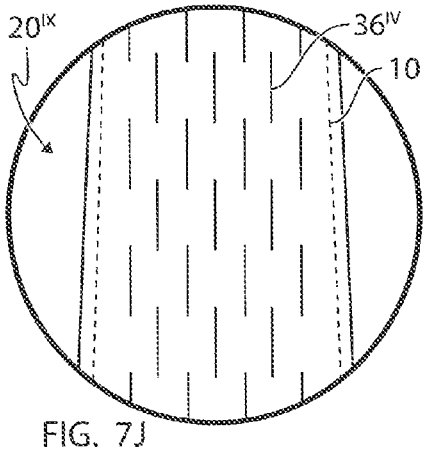

In FIG. 7J, a tenth embodiment of $\mathbf{20}^{IX}$ of the pelt board bag according to the present invention is shown, in which the embossings or score lines are constituted by linear segments $\mathbf{36}^{IV}$ orientated along the longitudinal axis of the pelt board bag $\mathbf{20}^{IX}$.

In FIGS. 8A, 8B, 8C and 8D, an eleventh embodiment $\mathbf{20}^{X}$, a twelfth embodiment $\mathbf{20}^{XI}$, a thirteenth embodiment $\mathbf{20}^{XII}$ and a fourteenth embodiment $\mathbf{20}^{XIII}$ of the pelt board bag according to the present invention are shown, respectively, illustrating different configurations or outlines of the outer contour of the pelt board bag relative to the outer contour of the expanded pelt board 10. The eleventh embodiment $\mathbf{20}^{X}$ exhibits a narrowed section at the central part of the pelt board bag and similarly, the twelfth embodiment $\mathbf{20}^{XI}$ of the pelt board bag exhibits an elongated conical section of a longitudinal extent far exceeding the extent of the conical upper part of the pelt board 20 and consequently, the twelfth embodiment $\mathbf{20}^{XI}$ of the pelt board bag exhibits a conical extension exceeding the length L2 of the pelt board 10 shown in FIG. 1.

The thirteenth embodiment $\mathbf{20}^{XII}$ of the pelt board bag shown in FIG. 8C is a double conical variant, in which a lower tapering part of the pelt board bag bridges the upper higher taper conical part with the lower non-conical part. The fourteenth embodiment $\mathbf{20}^{XIII}$ of the pelt board bag shown in FIG. 8D is a double conical variant, in which the lower section of the pelt board bag corresponds to the section 24 of the pelt board bag 20 shown in FIG. 1.

In FIGS. 9A, 9B, 9C, 9D and 9E a fifteenth embodiment $\mathbf{20}^{XIV}$, a sixteenth embodiment $\mathbf{20}^{XV}$, a seventeenth embodiment $\mathbf{20}^{XVI}$, an eighteenth embodiment $\mathbf{20}^{XVII}$ and a nineteenth embodiment $\mathbf{20}^{XVIII}$ are shown, respectively, in which embodiments different configurations of the upper part and the lower part of the pelt board bag are narrowed for providing the undersized part serving to cause the pelt board bag embodiment to be deformed into correspondence with the underlying pelt board 10. In the fifteenth embodiment $\mathbf{20}^{XIV}$ shown in FIG. 9A, the upper part is a double conical part, in which the upper higher tamper conical part is to be deformed into the configuration of the pelt board 10 by the opening of the slit or oblong apertures or tearing open the paper material of the pelt board bag by the presence of the embossings or score lines described above.

Similarly, in the sixteenth embodiment $\mathbf{20}^{XV}$ shown in FIG. 9B, the upper part of the pelt board bag is a double conical version having a minor transition part between the upper conical part and the lower non-conical part of the pelt board bag.

In the seventeenth, eighteenth and nineteenth embodiments $\mathbf{20}^{XVI}$, $\mathbf{20}^{XVII}$ and $\mathbf{20}^{XVIII}$, respectively, shown in FIGS. 9C, 9D and 9E, respectively, the lower part of the pelt board bag is configured for the conversion from the original configuration into a stretched out configuration corresponding to the outline of the pelt board 10. The seventeenth embodiment $\mathbf{20}^{XVI}$ shown in FIG. 9C constitutes so to speak a mirror image or an inverted variant of the eighteenth embodiment $\mathbf{20}^{XV}$ shown in FIG. 9B and the seventeenth embodiment $\mathbf{20}^{XVII}$ shown in FIG. 9D of the pelt board bag according to the present invention has a lower section of two different tapers, the one narrowing the section and the lower second section broadening the section.

In FIG. 9E, the nineteenth embodiment $\mathbf{20}^{XVIII}$ of the pelt board bag according to the present invention has a lower inversely tapering lower section to be deformed by the separation of the slits, oblong apertures or tearing apart of the embossings or score lines as described above for bringing the pelt board bag into conformity with the outline of the underlying pelt.

Finally, in FIGS. 10A and 10B, a twentieth and a twenty-first embodiment $\mathbf{20}^{XX}$ and $\mathbf{20}^{XX}$, respectively, are shown exhibiting a multiplicity of sections for conforming the pelt board bag in question to the underlying pelt board 10.

In FIG. 10A, the twentieth embodiment $\mathbf{20}^{XX}$ has a top part of a conical configuration in conformity with the outline of the underlying pelt board 10 and a somewhat lower taper conical section bridging the conical top part of the pelt board bag to a third section of a substantially rectilinear configuration and at its lower end, the twentieth embodiment $\mathbf{20}^{XX}$ of the pelt board bag has a narrowing taper section or conical section serving to be expanded for allowing the pelt board bag to be converted into a configuration in conformity with the outline of the pelt board 10.

The twenty-first embodiment 20 of the pelt board bag shown in FIG. 10 differs from the embodiment shown in FIG. 10A in that the two lower parts or sections of the pelt board bag are substituted by a single inversely tapering conical part for being conformed by deformation into the configuration outline of the pelt board 10 by the separation of the slit or oblong apertures, the separation of the embossings or score lines as described above.

In FIG. 11A is shown an intermediate product 38 in the form of an elongated piece of fat absorbing material used for manufacturing any of the pelt board bags described above. The intermediate product 38 thus constitutes a blank or preform, which as such is only useful for being further processed into a pelt board bag. The production of the intermediate product 38 is described in further detail below, whereas the present series of FIGS. 11 A-C describe the folding of the intermediate product 38 into a pelt board bag.

The intermediate product 38 is a single sheet or flat piece of material, which has been cut into a specific shape being an elongated conical shape. The intermediate product 38 is provided with perforations 26 30, which allow for the finalized pelt board bag to be ventilated, and slits 28 which allow for the finalized pelt board bag to be expanded, as described in detail above. Further, the intermediate product is provided with a pair of fold lines 40 40' along the complete length of the product 38, which are positioned at approximately 25% and 75% of the width of the intermediate product 38, i.e. the intermediate product 38 is split into two outermost parts and a central part, wherein the central part has about the same width as the two uttermost parts together, or slightly smaller.

FIG. 11B shows the folding of the intermediate product 38 along the fold lines 40 40' as indicated by the arrow. The folding, which is preferably made by a folding machine, is made easy by the provision of the fold lines 40 40'. The folding continues until the boundaries 42 42' of the intermediate product 38' meet in the middle between the fold lines 40 40'.

FIG. 11C shows the finished folding of the intermediate product into a pelt board bag 20. The boundaries 42 42' are assembled e.g. by gluing in order to form the pelt board bag 20, whereby the fold lines 40 40' constitute the longitudinal edges of the pelt board bag. It is contemplated that a small overlap is provided for at the meeting line of the boundaries 42 42' to allow for a simple and relatively strong assembly. The pelt board bags are typically stored in the flat first state for reducing the amount of space required, whereas when in use they are folded into the second basically tubular state along the fold lines.

FIG. 12 shows a cutting and stamping machine 44. The machine 44 is fed with a flat piece of fat absorbing material 46, typically paper, which may be fed from a roll in a "endless" configuration. The cutting and stamping machine 44 comprises a pair of rollers 48, which each comprises a die 50 for making the appropriate cuts, slits, oblong apertures, embossings, score lines and/or folds for producing an intermediate product 38, or in the present case two intermediate products 38 38' in a head to tail configuration. The rollers 48 and die 50 provides the multiple simultaneous function of:

a) cutting the general shape of the intermediate product of the pelt board bag.

b) making the regions provided with slits, oblong apertures, embossings, score lines and/or folds allowing the finished pelt board bag to expand, c) making the fold lines with slits, oblong apertures, embossings, score lines and/or folds allowing the intermediate product to be folded into a pelt board bag and the finished pelt board bag to shift easily between the first and second state.

Thereafter, the folding and assembling of the pelt board bag is effectuated as described in connection with FIGS. 11A-C.

In the following, a detailed explanation will be made of the meaning of slits, embossings, score lines and folds, which are useful both for the expansible regions as well as the fold lines:

FIG. 13A shows a cut-out view of a pelt board bag or intermediate product having slits 52, i.e. apertures reaching through the material 46.

FIG. 13B shows a perspective view of a pelt board bag or intermediate product having slits 52, i.e. cuts or apertures reaching through the material. The slits 52 are interrupted at regular intervals for allowing the material to stay together. The slits 52 may be staggered in order to achieve an expansible region.

FIG. 14A shows a cut-out view of a pelt board bag or intermediate product having scores 54, i.e. grooves which are only reaching partially through the material 46 on one side while maintaining a flat opposite side.

FIG. 14B shows a perspective view of a pelt board bag or intermediate product having scores 54, i.e. grooves, which are only reaching partially through the material 46 on one side while maintaining a flat opposite side. In the present case, the score is constituted by a continuous groove. When used in an expansible region, the scores are intended to tear thus in practice resulting in a slit at a predefined location. When used in a folding line, the scores are not intended to tear but to provide a hinging function. Thus, when combining scores both in the expansible region and in the folding line, care must be taken to avoid tearing of the folding line and thus it is preferred to use slits/folds in the expansible region while using scores/embossings in the fold lines.

FIG. 15A shows a cut-out view of a pelt board bag or intermediate product having embossings 56, i.e. grooves which are reaching partially through the material 46 on one side while exhibiting a protrusion at the opposite side.

FIG. 15B shows a perspective view of a pelt board bag or an intermediate product having embossings 56, i.e. grooves, which are reaching partially through the material 46 on one side while exhibiting a protrusion at the opposite side. The embossings have similar properties as the scores, however, as the material substantially maintains its thickness, i.e. no material is cut away, the embossings are stronger than the scores and it may thus be preferred to use embossings in the fold lines when scores are used in the expansible region, in order to ensure that the tearing of the material takes place at the region and not fold lines.

FIG. 16A shows a cut-out view of a pelt board bag or an intermediate product having multiple folds 58 in the material 46, forming a bellows allowing for flexibility.

FIG. 16B shows a perspective view of a pelt board bag or an intermediate product having multiple folds 58 in the material 46, forming a bellows allowing for flexibility. Similar to the embossings, the folds are stronger than the scores/slits as no material is cut away. Differently from the scores and embossings, the folds are not intended to be torn, the expansibility of the folded region lies in the flexibility of the bellows structure, allowing the region to be expansible. The folds may also be used in forming the fold lines, i.e. providing a folding indication.

Although the above description has in greater details described specific and presently preferred embodiments of the pelt board bag according to the present invention, alternative materials apart from those mentioned above constituting reusable material based on synthetic or natural fibers may be used and apart from the above-described single conical embodiment or the dual conical versions described, different configurations are contemplated covered by the appending claims as long as the protective scope defining the particular feature characteristic of the present invention or providing at least a single section allowing the pelt board bag to be widened longitudinally or transversally or in both directions is fulfilled. It is further to be realized that the above described numerous embodiments may readily be combined by the combination of teachings from one embodiment into another embodiment as to the configuration of the slits or apertures or the provision of embossings or score lines to be torn open, or the configuration of the sections of the pelt board bag having two or more sections configured in conformity with the contour of the pelt board or having a contour different from the pelt board as described above with reference to the drawings. Any such embodiments readily deducible in accordance with the ordinary skill of a person in the art are considered to be encompassed by the appending claims.

Points

1. A pelt board bag of a fat absorbing and optionally and preferably also moisture and water absorbing material for use in combination with and applied externally to a pelt board for the tanning and drying of a pelt applied externally to the pelt board bag, said bag comprising:

i) a pair of oppositely positioned and substantially coextensively extending, elongated sheets of said material, ii) said pair of sheets being joined together along opposite longitudinal edges and defining in a first state a flat two-layer structure and in a second state a basically tubular state, iii) said pair of sheets defining opposite first and second ends, said first end constituting a narrow open end constituting a top end when used in combination with said pelt board and said second end constituting a broader bottom end when used in combination with said pelt board, said pair of sheets defining in said second state an inner perimeter varying from said first narrow end to said broader second end, and iv) said pair of sheets or at least one of said pair of sheets having a region at a specific inner perimeter, said region being provided with slits, oblong apertures, embossings, score lines, folds or combinations thereof allowing said region to be expanded at least in one direction longitudinally or transversely when in said second state.

2. The pelt board according to point 1, said region being bounded by two inner perimeters along the longitudinal extend of said pelt board bag.

3. The pelt board bag according to any of the points 1 or 2, said pelt board bag defining when in said second state an overall conical configuration or a configuration composed of one or more cones and/or a circular cylindrical section.

4. The pelt board bag according to any of the points 1-3, said region being provided at a conical part of the pelt board bag such as a part corresponding to a tapered part of said pelt board or at a transition from a higher taper to a lower taper corresponding to the transition at said pelt board between a tapering part and a non-tapering part.

5. The pelt board bag according to any of the preceding points, said slit, or oblong apertures, embossings or score lines being provided extending longitudinally relative to said pelt board bag or alternatively transversely relative to said pelt board bag.

6. The pelt board bag according to any of the points 1-4, said slits, oblong apertures, embossings or score lines being sloping relative to said longitudinal direction of said pelt board bag.

7. The pelt board bag according to point 6 or 7, said slits being linear or substantially linear slits having rounded apertured ends for preventing the propagation of tearing of said sheet material when expanding said region.

8. The pelt board bag according to any of the preceding points, said material being paper or cardboard or fiber material made from synthetic or natural fibers and/or combinations thereof.

9. The pelt board bag according to any of the preceding points, said pair of sheets being joined along said opposite longitudinal edges by gluing, welding or an integral hinge connection between said pair of sheets.

10. An assembly of a pelt board bag of a fat absorbing and optionally and preferably also moisture and water absorbent material and a pelt board for use in combination with said pelt board bag for applying said pelt board bag externally to said pelt board for tanning and drying of a pelt applied externally to said pelt board bag, said bag comprising:

i) a pair of oppositely positioned and substantially coextensively extending, elongated sheets of said material, ii) said pair of sheets being joined together along opposite longitudinal edges and defining in a first state a flat two-layer structure and in a second state a basically tubular state, iii) said pair of sheets defining opposite first and second ends, said first end constituting a narrow open end constituting a top end when used in combination with said pelt board and said second end constituting a broader bottom end when used in combination with said pelt board, said pair of sheets defining in said second state an inner perimeter varying from said first narrow end to said broader second end, iv) said pair of sheets or at least one of said pair of sheets having a region at a specific inner perimeter, said region being provided with slits, oblong apertures, embossings, score lines, folds or combinations thereof allowing said region to be expanded at least in one direction longitudinally or transversely when in said second state, and v) said pelt board being shiftable between a collapsed state and a non-collapsed state, and said pelt board bag being applicable externally to said pelt board when in said collapsed state without expanding said region and said region being expanded when said pelt board is in said non-collapsed state or is caused to be expanded when shifting said pelt board from said collapsed state to said non-collapsed state.

11. The assembly according to point 10, said pelt board bag having any of the features of the pelt board bag according to any of the point 1-9.

The invention claimed is:

1. An assembly for tanning and drying a pelt, comprising: a pelt board; and a pelt board bag disposed externally on the pelt board and configured to hold a pelt to be tanned and dried, the pelt board bag comprising a sheet of fat-absorbing material folded along a fold line extending between a first end of the sheet and an opposite second end of the sheet, the sheet having two opposed longitudinal boundaries extending between the first end and the second end that are joined together to define, in a first state, a flat two-layer structure, and in a second state, a substantially tubular structure;

wherein the pelt board bag further defines an open top end and an open bottom end when the pelt board bag is disposed on the pelt board, wherein the bottom end is broader than the top end, the pelt board bag defining, in the second state, a perimeter that increases from the top end to the bottom end; and wherein the fold line is defined by a folding feature selected from the group consisting of one or more of slits, oblong apertures, embossings, and score lines.

2. The assembly according to claim 1, wherein the pelt board is shiftable between a collapsed state and a non-collapsed state, whereby the pelt board bag is applicable externally to the pelt board when the pelt board is in the collapsed state.

3. An intermediate product comprising a sheet of fat absorbing material for being further processed into a pelt board bag for use in combination with and applied externally to a pelt board for the tanning and drying of a pelt applied externally to the pelt board bag, the sheet of fat absorbing material comprising:

first and second opposed longitudinal boundaries extending between a first end of the sheet and an opposite second end of the sheet and configured to be joined to each other, wherein the second end of the sheet is broader than the first end of the sheet; and a fold line extending between the first end of the sheet and the second end of the sheet, whereby, when the sheet is folded along the fold line, the first and second longitudinal boundaries are joinable to each other so that the sheet defines, in a first state, a flat two-layer structure, and in a second state, a tubular structure having an inner perimeter increasing from a first open end defined by the first end of the sheet to a second open end defined by the second end of the sheet wherein the fold line is defined by a folding feature selected from the group consisting of one or more of slits, oblong apertures, embossings, and score lines.

4. A method of manufacturing a pelt board bag configured to be applied externally to a pelt board for the tanning and drying of a pelt applied externally to the pelt board bag, the method comprising the steps of:

i) providing a sheet of fat absorbing material having first and second opposed longitudinal boundaries, and a first end and an opposite second end that is broader than the first end;

ii) making a folding feature in the sheet, the folding feature being selected from the group consisting of one or more of slits, apertures, embossings, and score lines, in the sheet to define a fold line extending between the first end and the second end;

iii) folding the sheet along the fold line; and iv) joining the first and second longitudinal boundaries to each other to form a bag having a first state defining a flat two-layer structure, and a second state defining a tubular shape having a perimeter that increases from a first open defined by the first end of the sheet to a second open end defined by the second end of the sheet.

5. A pelt board bag configured to be applied externally to a pelt board for the tanning and drying of a pelt applied externally to the pelt board bag, the pelt board bag comprising a sheet of fat-absorbing material folded along a fold line extending between a first end of the sheet and an opposite second end of the sheet, the sheet having first and second opposed longitudinal boundaries extending between the first end of the sheet and the second end of the sheet and joined together to define, in a first state, a flat two-layer structure, and in a second state, a substantially tubular structure;

wherein the pelt board bag, in the second state, defines an open top end and an open bottom end when the pelt board bag is used in combination with a pelt board, the bottom end being broader than the top end, the pelt board bag defining, in the second state, a perimeter that increases from the top end to the bottom end; and wherein the fold line is defined by a folding feature selected from the group consisting of one or more of slits, oblong apertures, embossings, and score lines, and folds.

6. The pelt board bag according to claim 5, wherein the sheet includes an expansible region having an expansion feature selected from the group consisting of one or more of slits, oblong apertures, embossings, and score lines, and wherein the expansible region is expansible in at least in one of a longitudinal direction and a transverse direction when the pelt board bag is in the second state.

7. The pelt board according to claim 6, wherein the expansible region is bounded by two inner perimeters along a longitudinal extent of the pelt board bag.

8. The pelt board bag according to claim 5, wherein the pelt board bag defines, when in the second state, an overall conical configuration.

9. The pelt board bag according to claim 5, wherein the pelt board bag defines, when in the second state, a configuration comprising one or more cones.

10. The pelt board bag according to claim 5, wherein the pelt board bag includes, when in the second state, a circular cylindrical section.

11. The pelt board bag according to claim 6, wherein the expansible region is located at a conical part of the pelt board bag.

12. The pelt board bag according to claim 11, wherein the conical part corresponds to a tapered part of the pelt board bag.

13. The pelt board bag according to claim 11, wherein the conical part corresponds to a part of the pelt board bag transitioning between a large taper and a small taper.

14. The pelt board bag according to claim 6, wherein the expansion feature comprises slits that are substantially linear with rounded apertured ends configured to inhibit the propagation of tearing of the sheet when the expansible region is expanded.

* * * * *